US011623330B2

(12) United States Patent
Ootsuka et al.

(10) Patent No.: US 11,623,330 B2
(45) Date of Patent: Apr. 11, 2023

(54) DRIVING TOOL

(71) Applicant: KOKI HOLDINGS CO., LTD., Tokyo (JP)

(72) Inventors: Kazuhiro Ootsuka, Ibaraki (JP); Yoshimitsu Iijima, Ibaraki (JP)

(73) Assignee: KOKI HOLDINGS CO., LTD., Tokyo (JP)

( * ) Notice: Subject to any disclaimer, the term of this patent is extended or adjusted under 35 U.S.C. 154(b) by 137 days.

(21) Appl. No.: 17/265,087

(22) PCT Filed: Aug. 2, 2019

(86) PCT No.: PCT/JP2019/030466

§ 371 (c)(1),
(2) Date: Feb. 1, 2021

(87) PCT Pub. No.: WO2020/031887

PCT Pub. Date: Feb. 13, 2020

(65) Prior Publication Data

US 2021/0308851 A1 Oct. 7, 2021

(30) Foreign Application Priority Data

Aug. 6, 2018 (JP) ..... JP2018-147512

(51) Int. Cl.
*B25C 1/04* (2006.01)

(52) U.S. Cl.
CPC ..... *B25C 1/047* (2013.01); *B25C 1/045* (2013.01); *B25C 1/046* (2013.01)

(58) Field of Classification Search
CPC ..... B25C 1/047; B25C 1/045; B25C 1/046; B25C 1/043; B25C 1/04; F16K 31/60
See application file for complete search history.

(56) References Cited

U.S. PATENT DOCUMENTS 5,551,620 A 9/1996 Vallee
5,551,621 A 9/1996 Vallee
2006/0213945 A1 9/2006 Ke
(Continued)

FOREIGN PATENT DOCUMENTS

JP 2009-285750 A 12/2009
JP 2017-131994 A 8/2017
(Continued)

OTHER PUBLICATIONS

Extended European Search Report for EP Application No. 19846166.7 dated Apr. 20, 2022. 24 pages.
(Continued)

*Primary Examiner* — Anna K Kinsaul
*Assistant Examiner* — Luis G Del Valle
(74) *Attorney, Agent, or Firm* — ivicLErmott Will & Emery LLP

(57) ABSTRACT

A driving tool without necessary to secure an arrangement space dedicated to an actuator is provided. A driving tool includes: a striking unit movable to strike a fastener; a housing for supporting the striking unit; a trigger provided in the housing; a push lever provided in the housing, and a trigger valve, and the driving tool further includes: a slide member provided in the trigger; and a solenoid provided in the trigger and configured to move the slide member.

10 Claims, 15 Drawing Sheets

(56) References Cited

U.S. PATENT DOCUMENTS

2009/0090762 A1* 4/2009 Leimbach ..... B25C 5/13 227/136
2010/0258607 A1* 10/2010 Lam ..... B25C 1/008 227/8
2012/0181319 A1* 7/2012 Iijima ..... B25B 21/023 227/8
2012/0318841 A1* 12/2012 Liu ..... B25C 1/047 227/130
2014/0110450 A1 4/2014 Moore et al.
2014/0110452 A1 4/2014 Moore et al.
2016/0114470 A1* 4/2016 Weigmann ..... B25C 1/047 227/8
2016/0279774 A1 9/2016 Moore et al.
2017/0129084 A1 5/2017 Moore et al.
2017/0209995 A1 7/2017 Iijima et al.
2017/0274512 A1 9/2017 Ishizawa
2018/0117748 A1* 5/2018 Ishikawa ..... B25C 1/046
2018/0126528 A1* 5/2018 Pomeroy ..... B25C 1/06
2018/0178361 A1* 6/2018 Kabbes ..... B25C 1/008
2019/0022842 A1 1/2019 Oouchi
2019/0184536 A1 6/2019 Moore et al.
2020/0189079 A1 6/2020 Iijima et al.

FOREIGN PATENT DOCUMENTS

WO 2016/002540 A1 1/2016
WO 2017/115593 A1 7/2017

OTHER PUBLICATIONS

International Search Report issued in corresponding International Patent Application No. PCT/JP2019/030466, dated Oct. 15, 2019, with English translation.

* cited by examiner

10 : DRIVING TOOL
11 : HOUSING
13 : STRIKING UNIT
14 : TRIGGER
16 : PUSH LEVER
46 : SOLENOID
51 : TRIGGER VALVE
73 : FASTENER
81 : SLIDE MEMBER

DRIVING TOOL

CROSS REFERENCE TO RELATED APPLICATIONS

This application is the U.S. National Phase under 35 U.S.C. § 371 of International Patent Application No. PCT/JP2019/030466, filed on Aug. 2, 2019, which claims the benefits of Japanese Patent Application No. 2018-147512, filed on Aug. 6, 2018, the entire contents of which are hereby incorporated by reference.

TECHNICAL FIELD

The present invention relates to a driving tool including a striking unit which moves in a predetermined direction and strikes a fastener, and a driving unit which moves the striking unit.

BACKGROUND ART

A driving tool including a striking unit and a driving unit is described in Patent Document 1. The driving tool described in the Patent Document 1 includes a housing, a pressure accumulation chamber, a pressure chamber, a striking unit, a push lever, a cylinder, a trigger, a trigger valve, and a delay valve as an actuator. The pressure accumulation chamber is provided in the housing, and compressed air is supplied to the pressure accumulation chamber.

When an operator uses the driving tool described in the Patent Document 1, the delay valve connects a path for use in supplying the compressed gas of the pressure accumulation chamber to the pressure chamber during a predetermined time from application of an operational force to the trigger by the operator. Thus, when the operational force is applied to the push lever within the predetermined time from the application of the operational force to the trigger, the compressed air is supplied to the pressure chamber, and the striking unit moves in the direction of striking a fastener.

On the other hand, after the predetermined time has elapsed from the application of the operational force to the trigger, the delay valve disconnects the path for use in supplying the compressed gas from the pressure accumulation chamber to the pressure accumulation chamber. Thus, even if the operational force is applied to the push lever after the predetermined time has elapsed from the application of the operational force to the trigger, the compressed air is not supplied to the pressure chamber. In other words, the striking unit does not move in the direction of striking the fastener.

RELATED ART DOCUMENT

Patent Document

Patent Document 1: International Patent Publication No. WO2017-115593

SUMMARY OF THE INVENTION

Problems to be Solved by the Invention

The inventors of the present application have found that it is necessary to secure an arrangement space dedicated to an actuator.

An objective of the present invention is to provide a driving tool which can eliminate the need for securing the arrangement space dedicated to the actuator.

Means for Solving the Problems

A driving tool of one embodiment includes: a striking unit configured to be movable to strike a fastener; a housing configured to support the striking unit; an operation member provided in the housing and configured to be moved by an operational force of an operator; a contact member provided in the housing and configured to be movable in contact with a workpiece into which the fastener is driven; and a driving unit configured to have a standby state in which the striking unit is stopped and a movement state in which the striking unit is moved, and configured to be switched between the standby state and the movement state when a switching member moves, and the driving tool further includes: a transmission mechanism operably provided in the operation member and configured to have a transmission state in which a movement force of the operation member and a movement force of the contact member can be transmitted to the switching member and a disconnection state in which the movement force of the operation member and the movement force of the contact member cannot be transmitted to the switching member; and an actuator provided in the operation member and configured to switch the transmission mechanism between the transmission state and the disconnection state.

Effects of the Invention

According to the driving tool of one embodiment, the need for securing the dedicated arrangement space for use in arranging the actuator can be eliminated.

BRIEF DESCRIPTIONS OF THE DRAWINGS

Figure 4A:
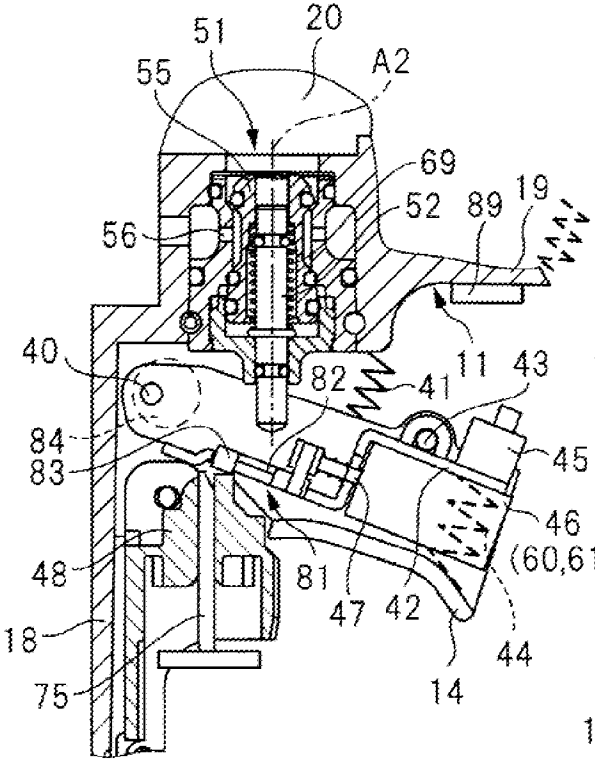
Figure 4B:
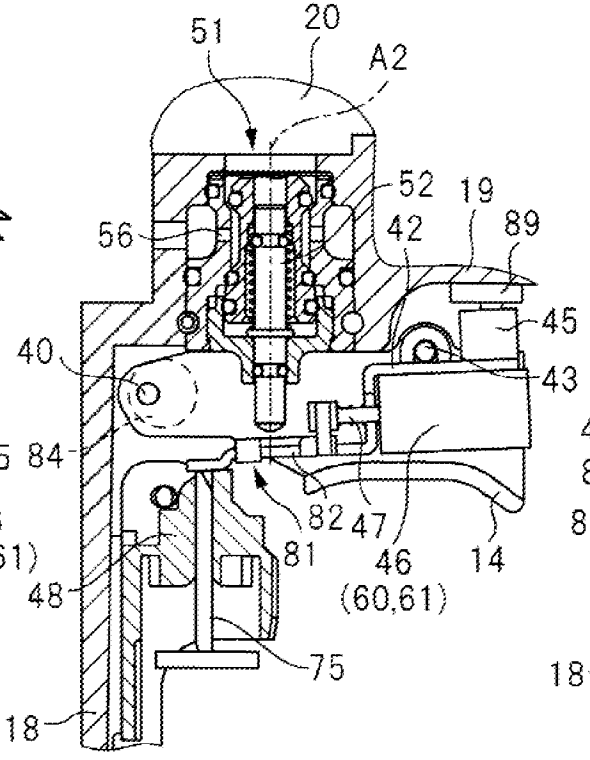
Figure 4C:
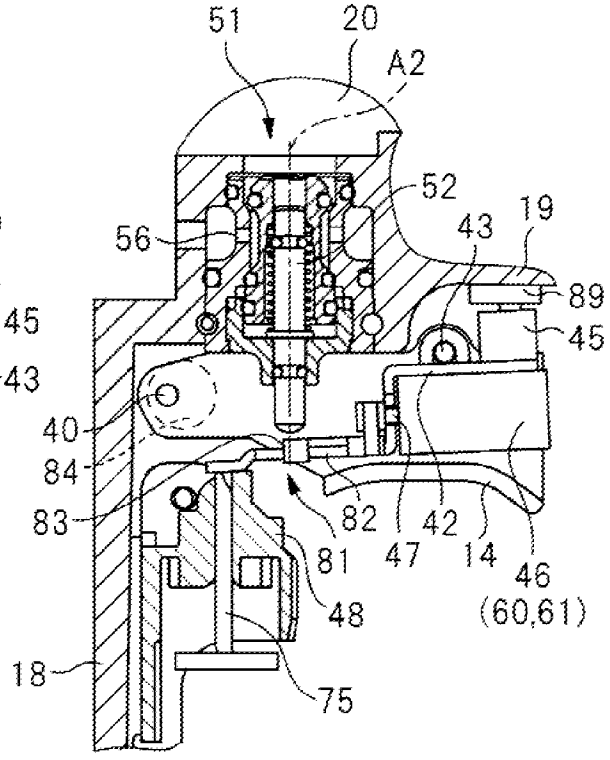
Figure 5B:
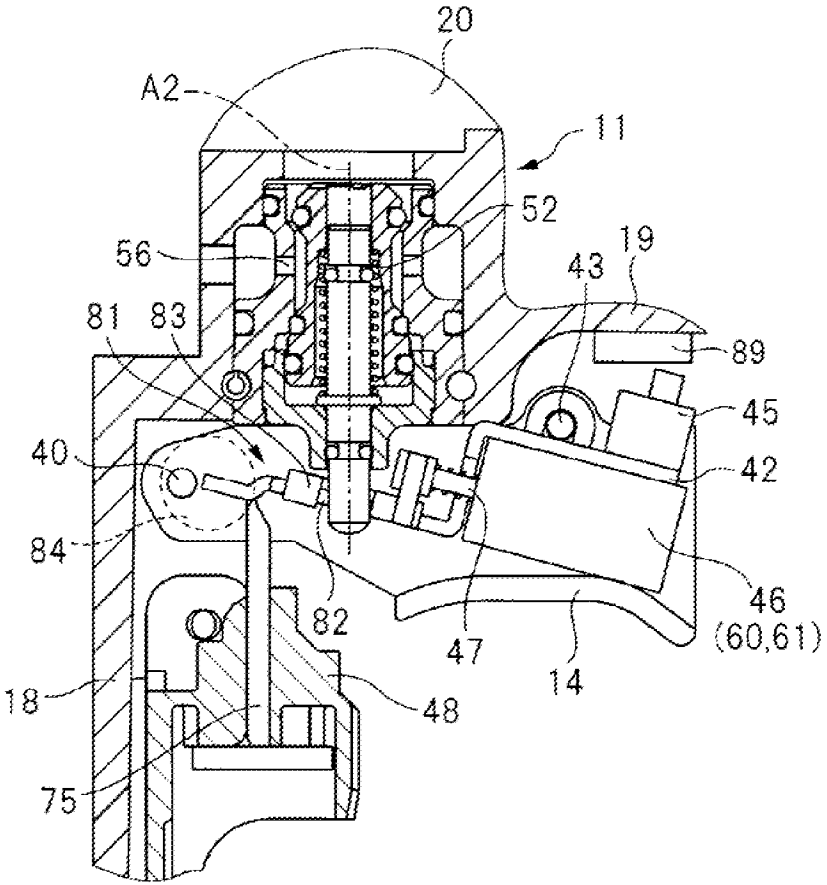
Figure 5A:
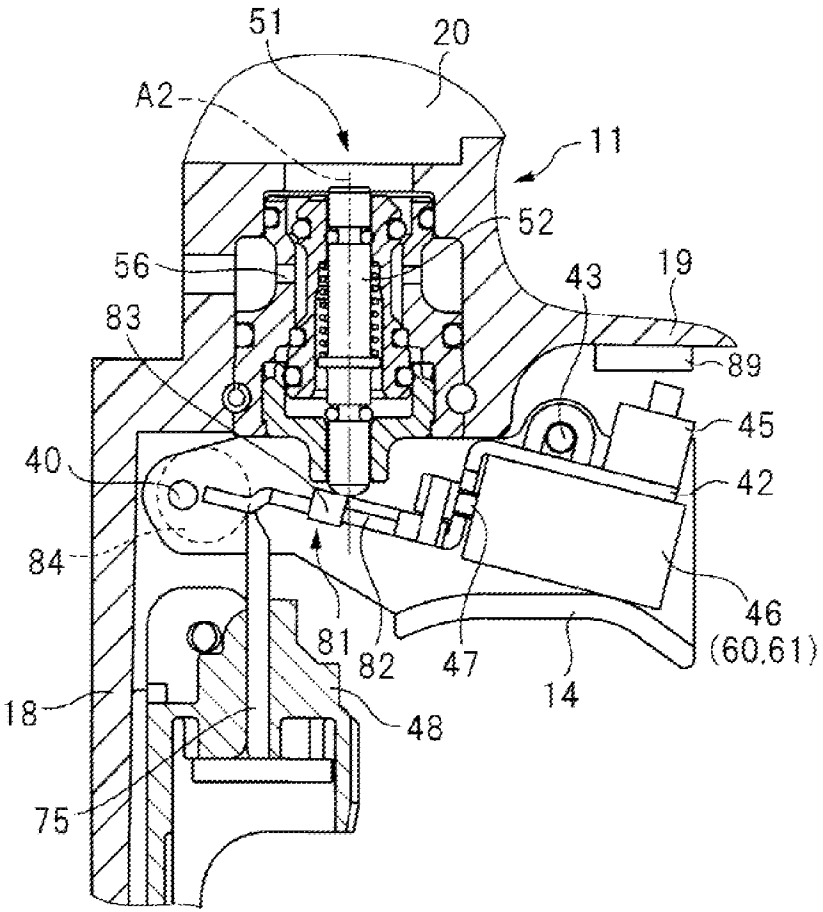
Figure 6B:
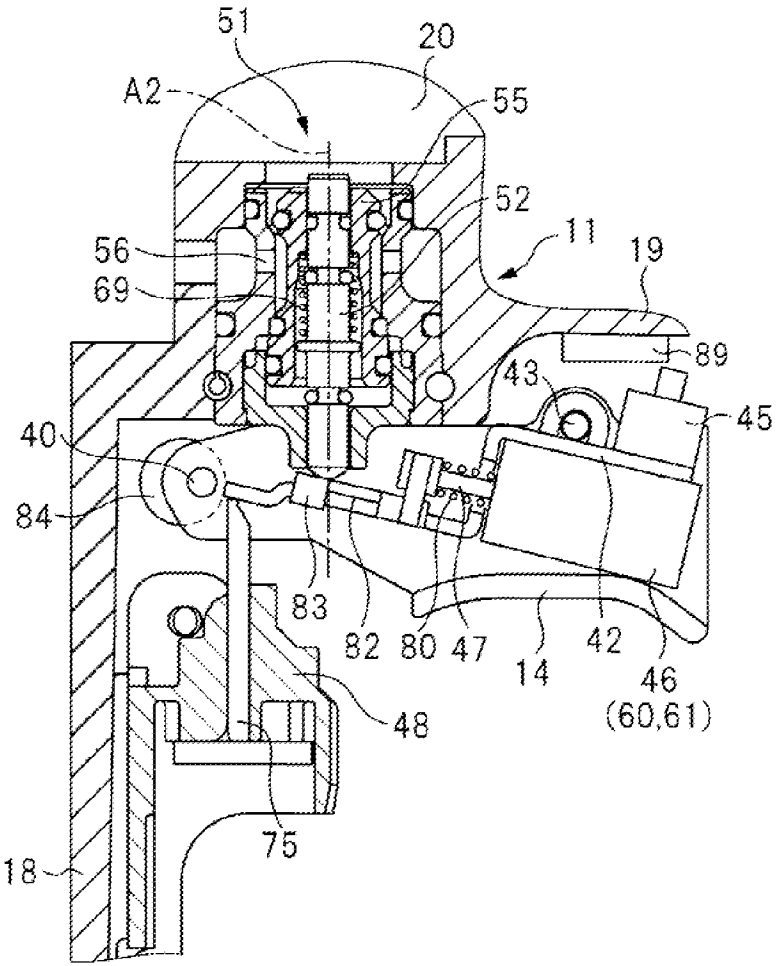
Figure 6A:
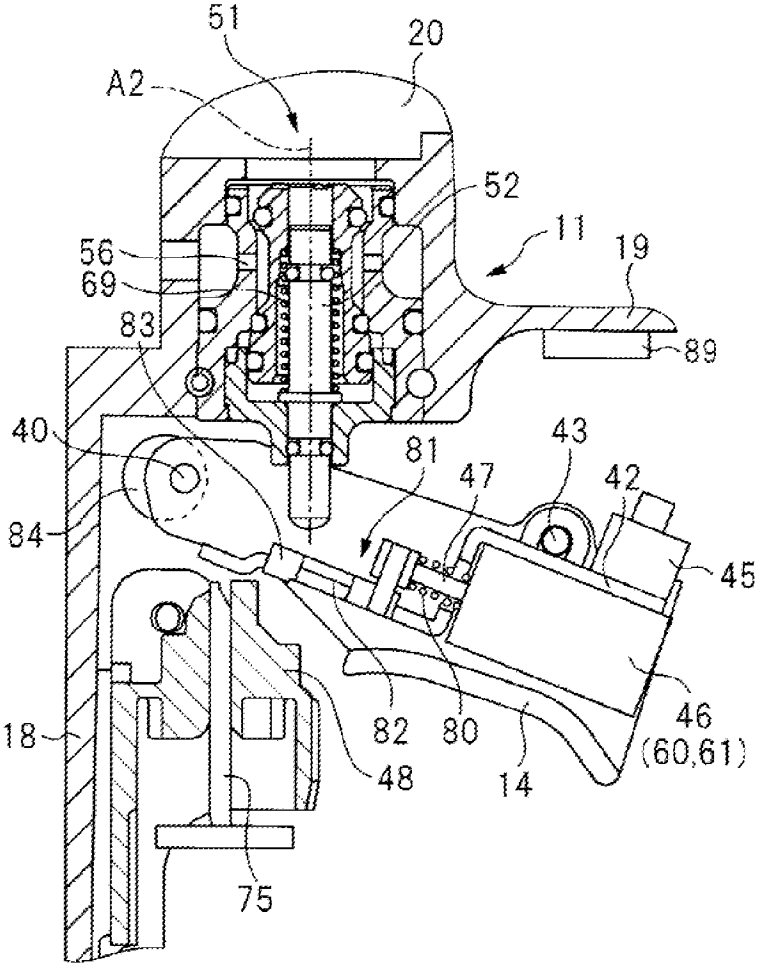
Figure 7:
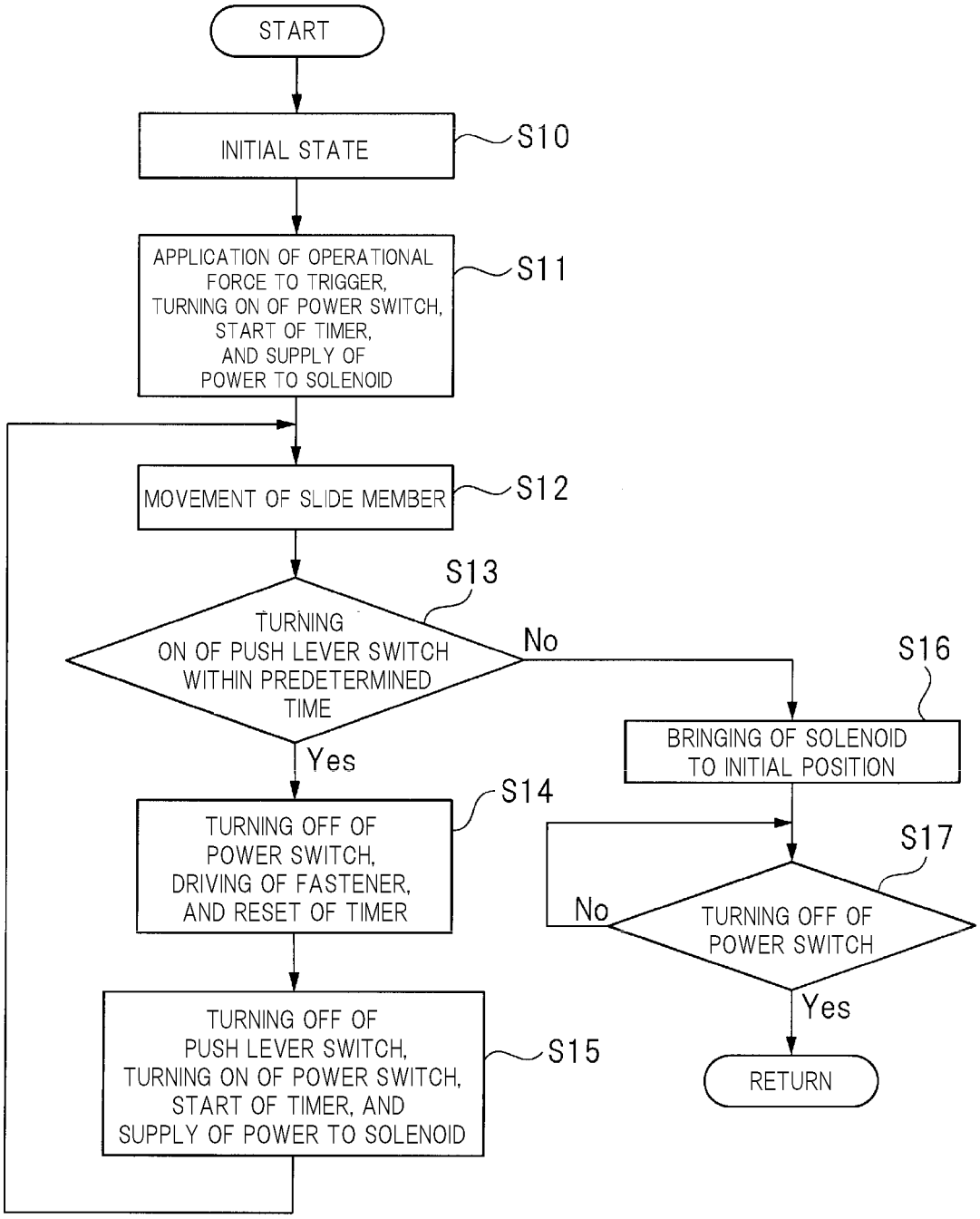
Figure 8A:
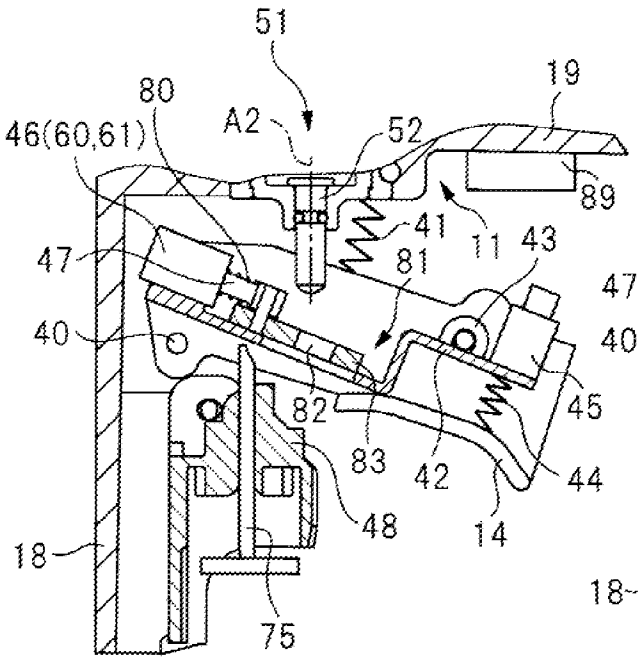
Figure 8B:
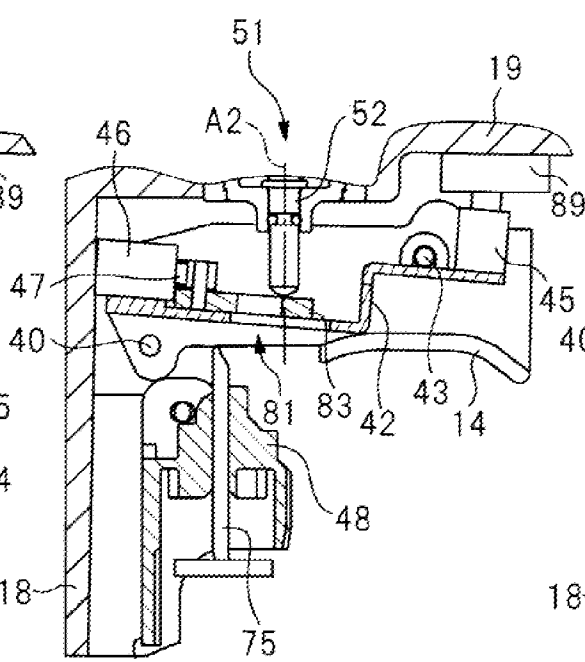
Figure 8C:
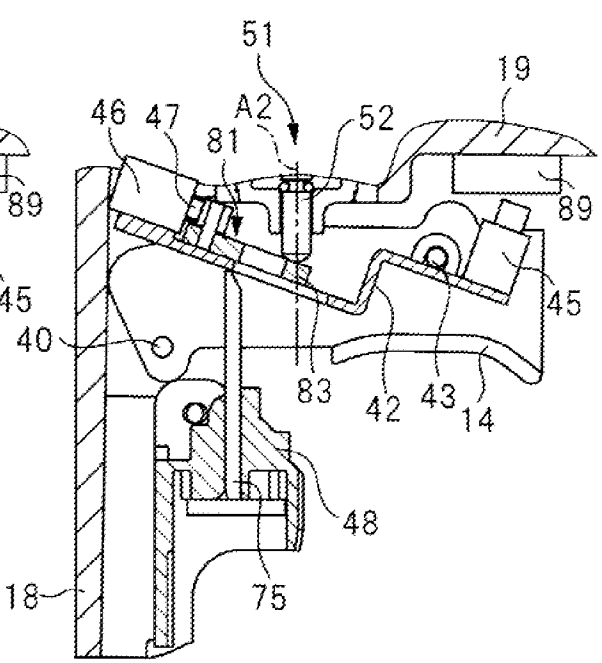
Figure 9B:
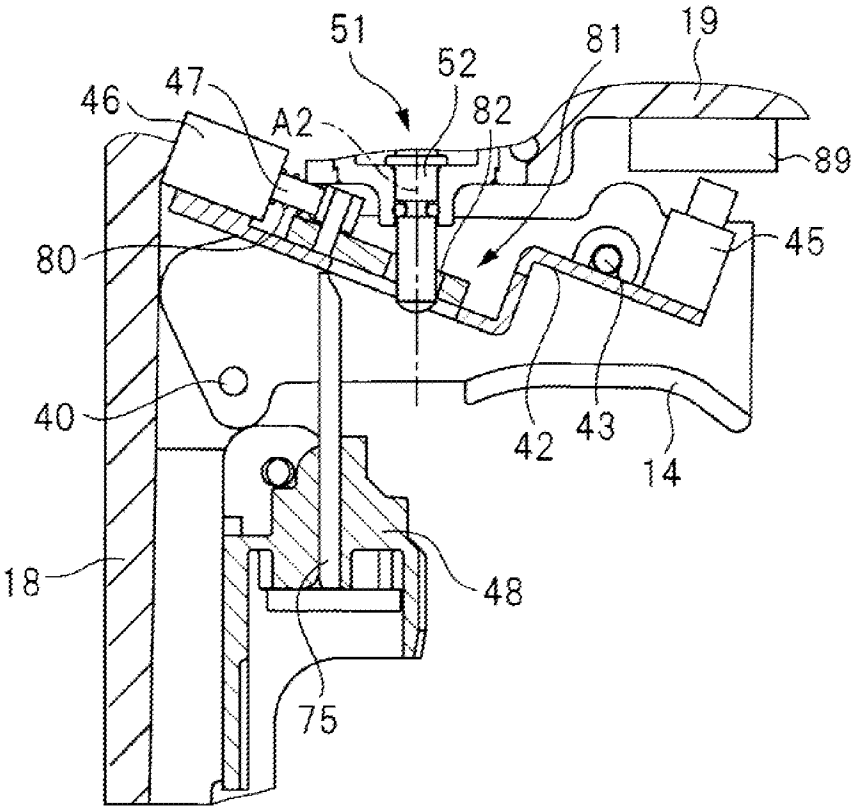
Figure 9A:
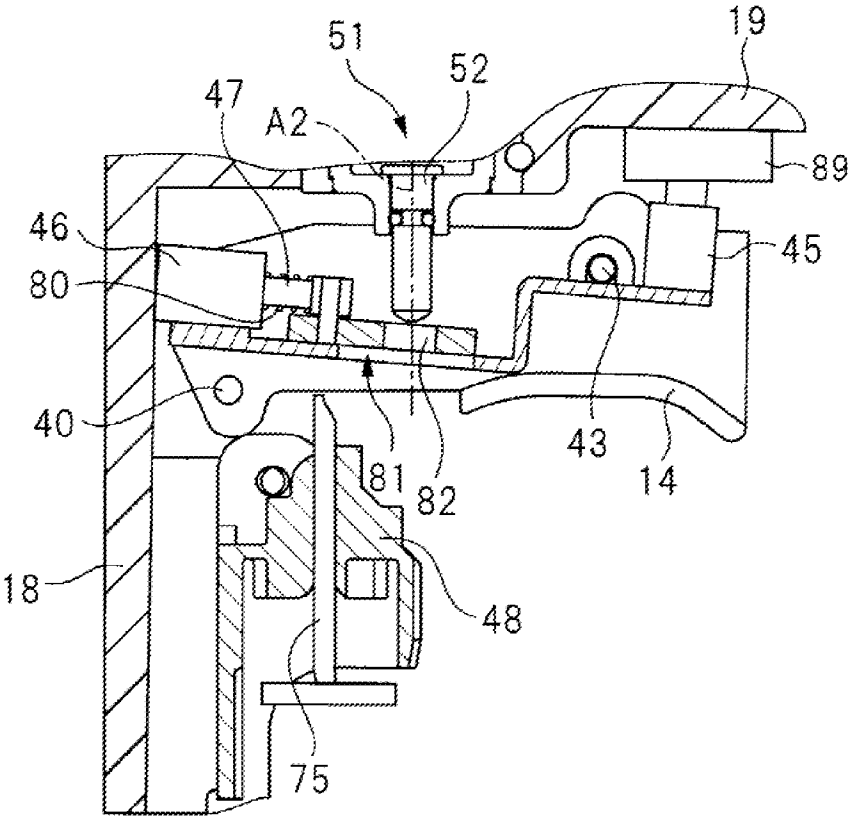
Figure 10C:
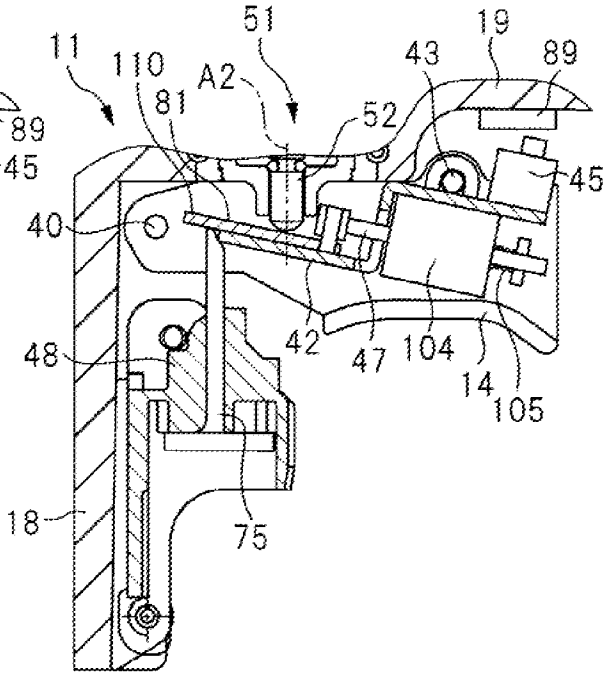
Figure 10B:
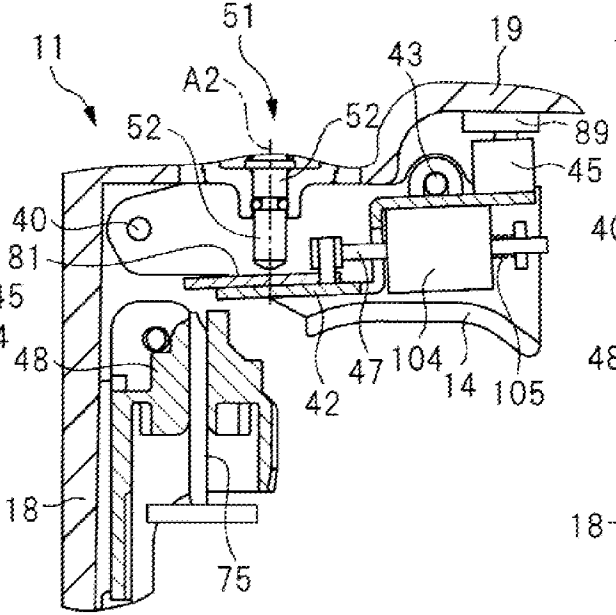
Figure 10A:
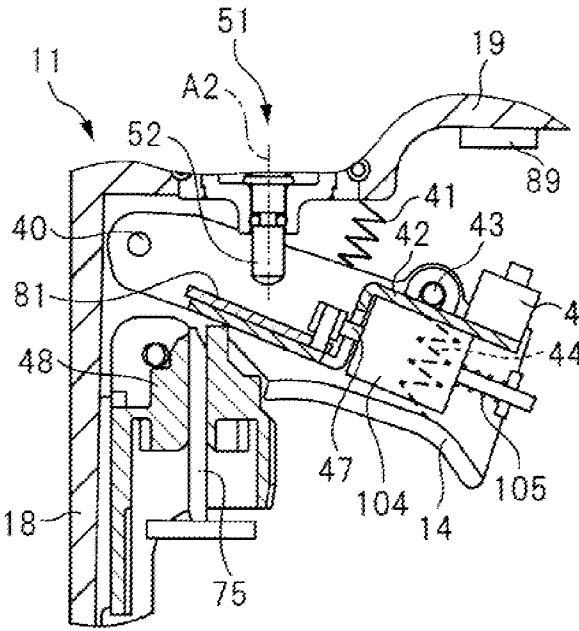
Figure 11B:
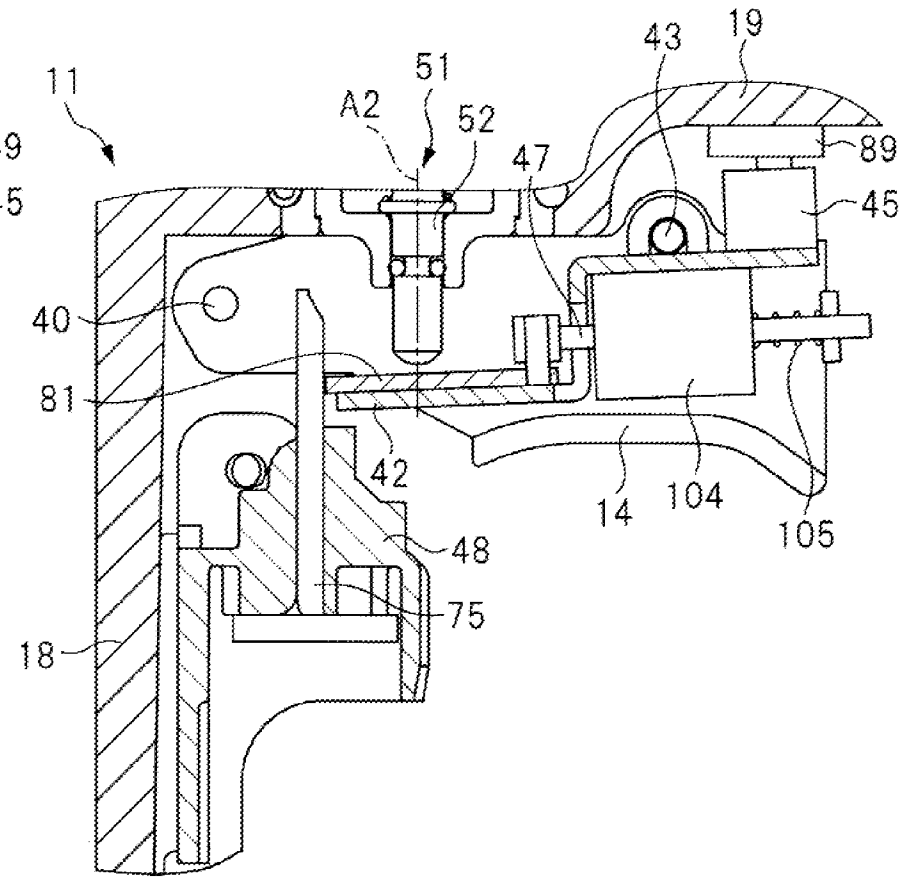
Figure 11A:
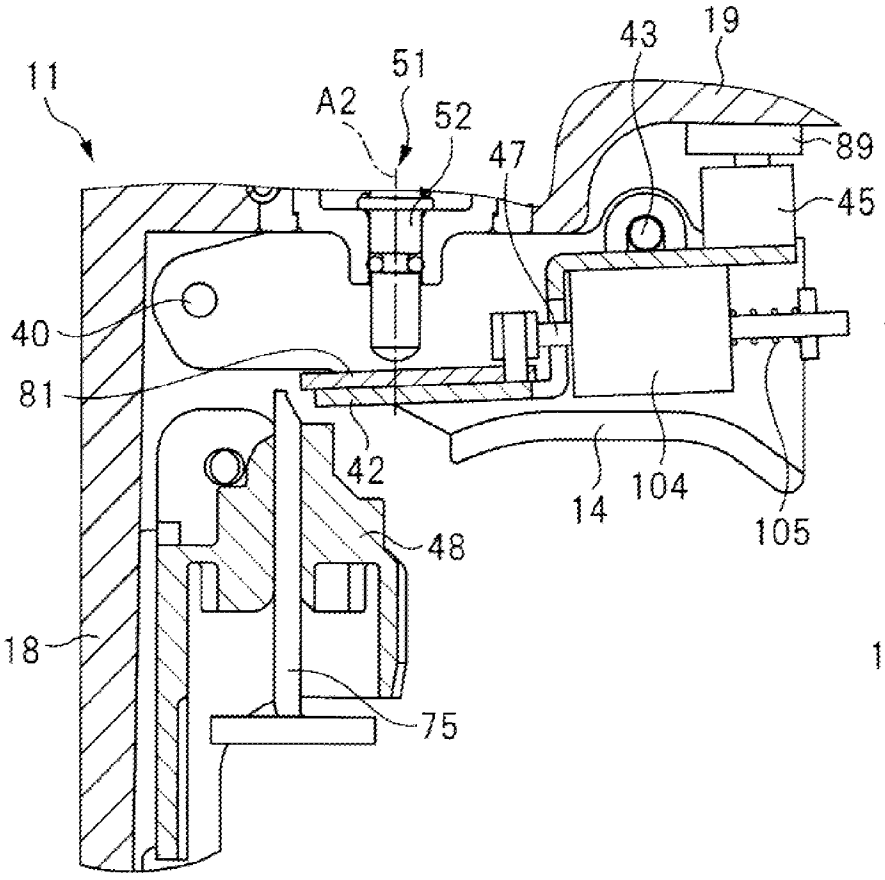
Figure 12A:
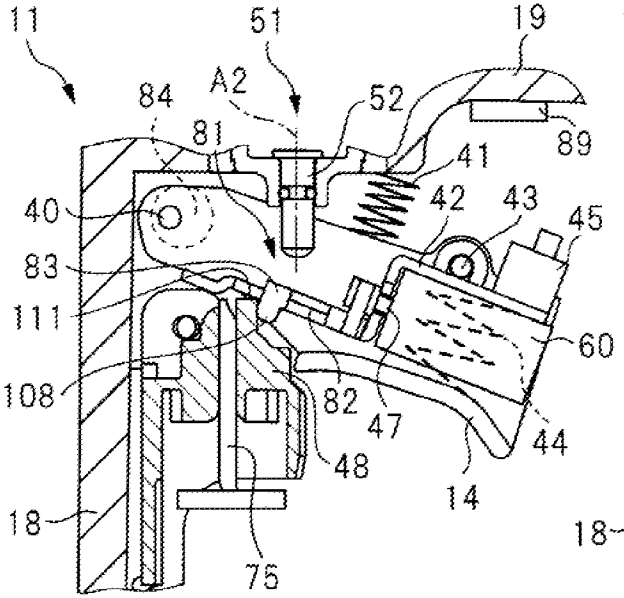
Figure 12B:
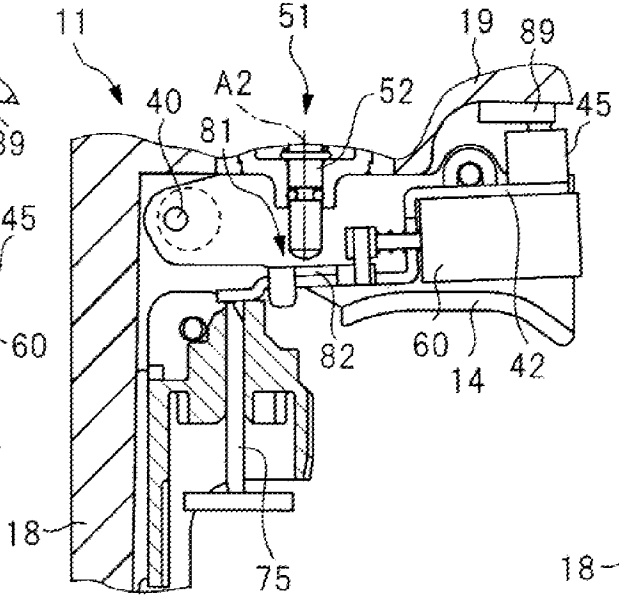
Figure 12C:
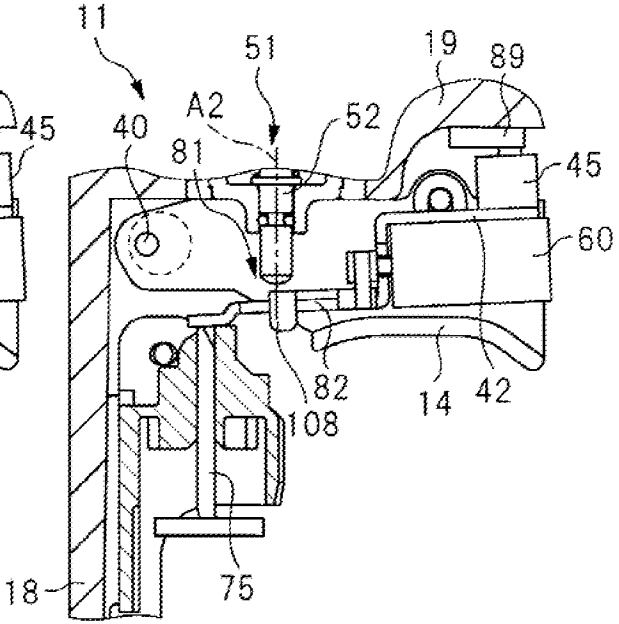
Figure 13B:
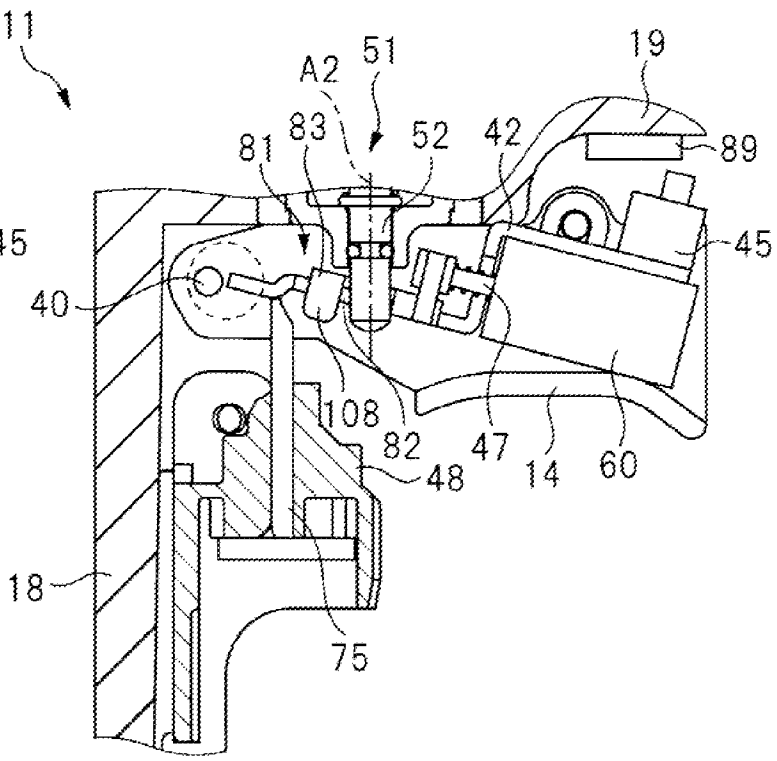
Figure 13A:
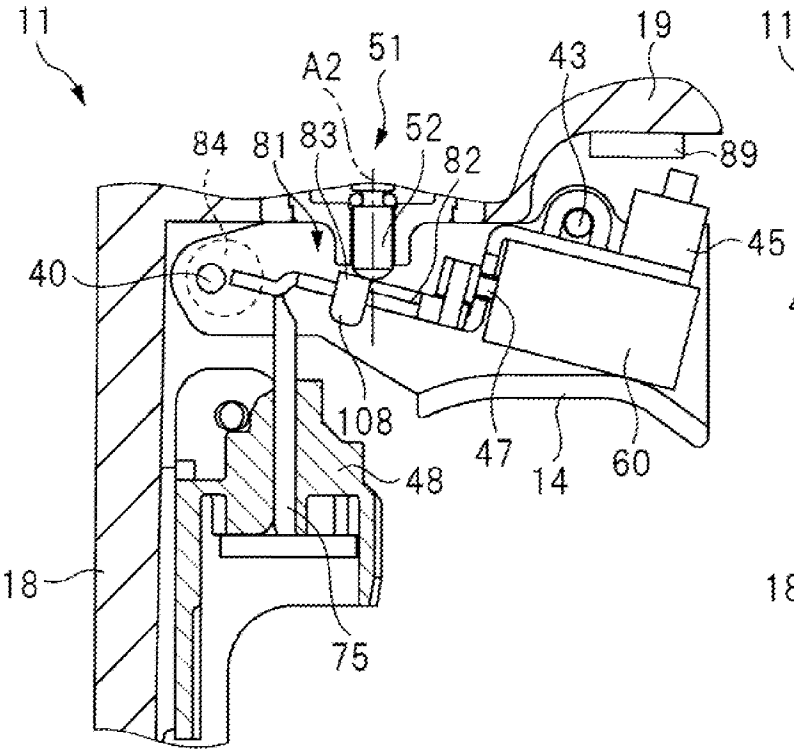
Figure 14:
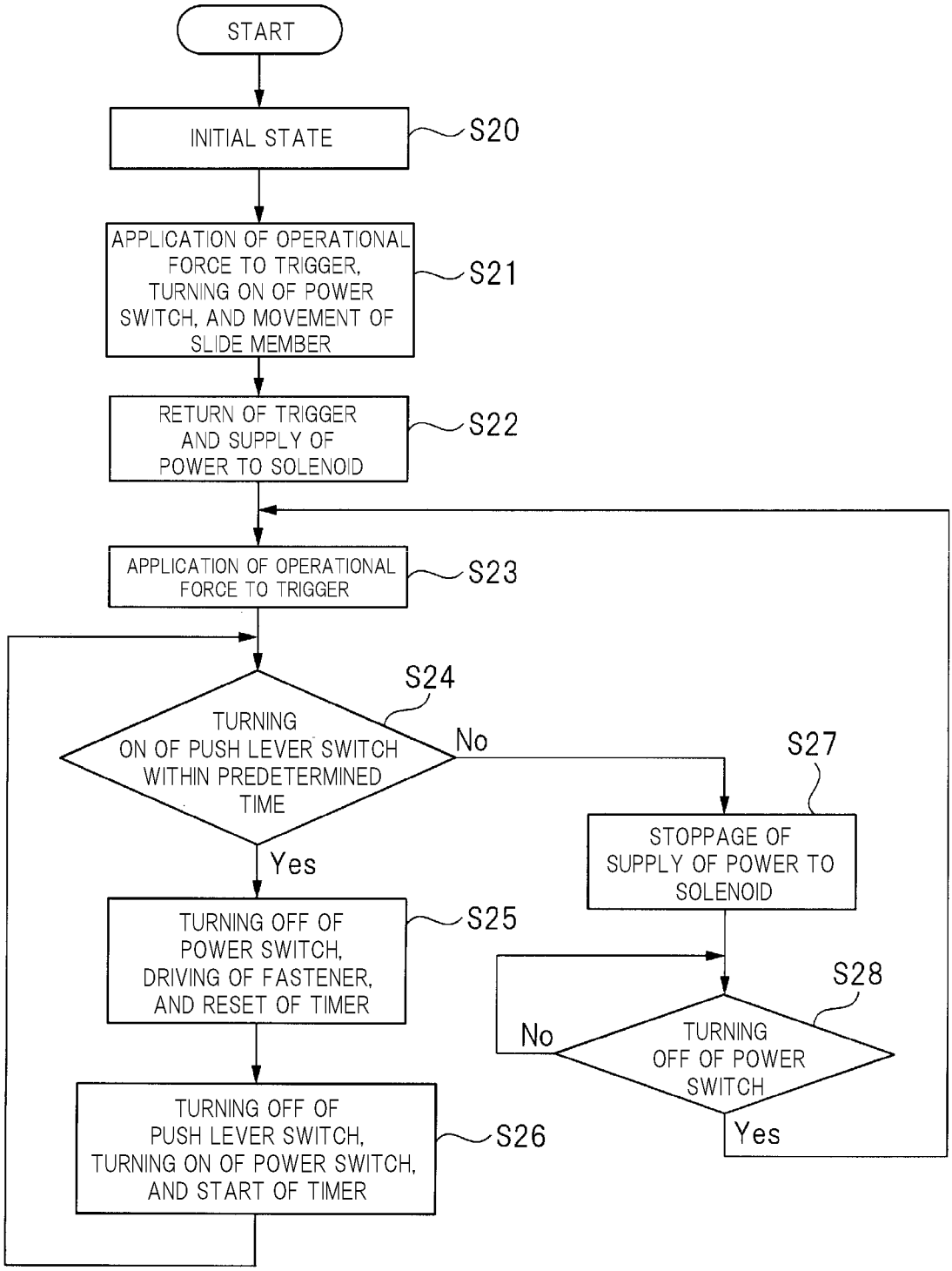
Figure 15B:
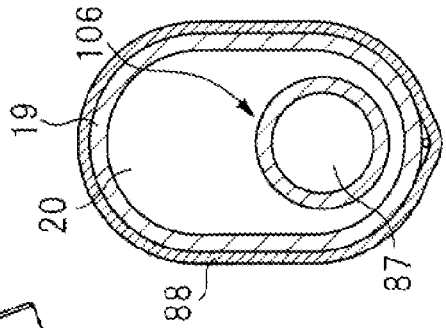
Figure 15A:
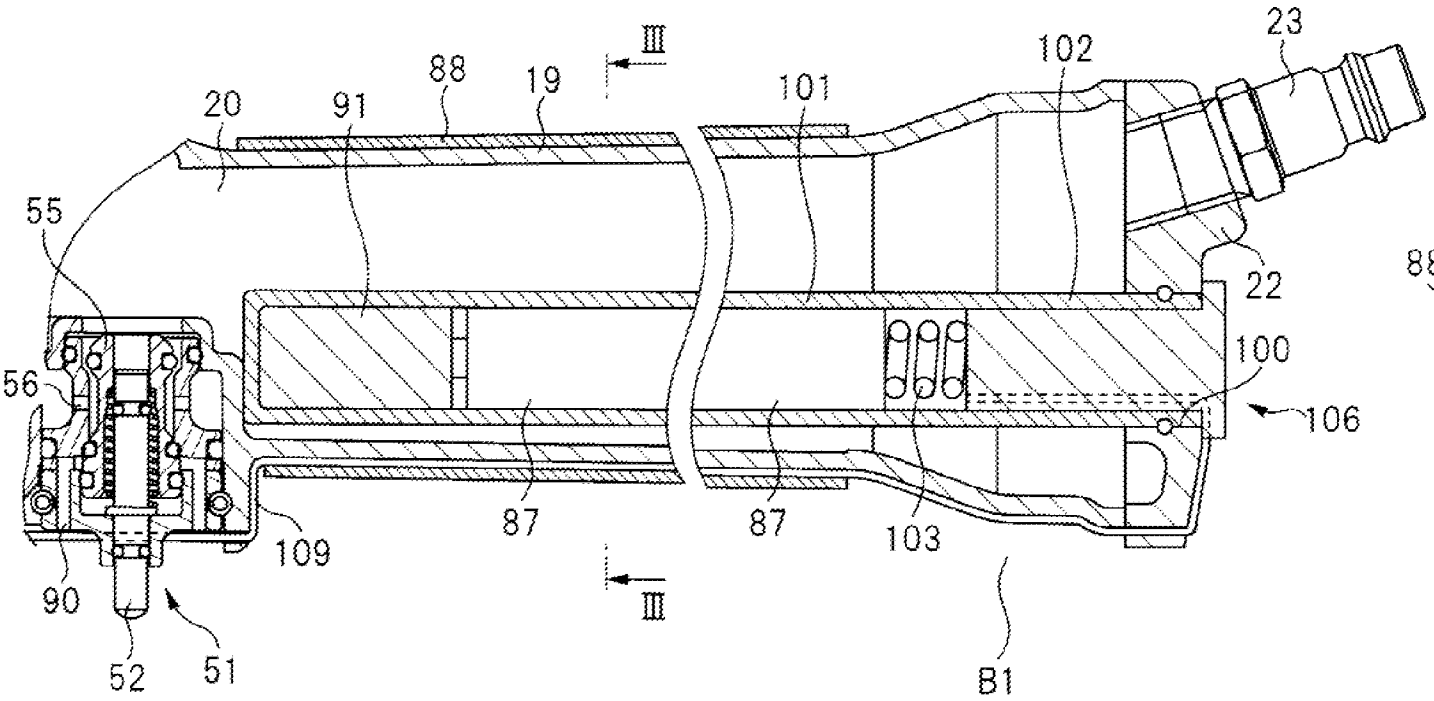

FIGS. 4(A), 4(B), and 4(C) are cross-sectional views each showing the operation of the trigger;

FIGS. 5(A) and 5(B) are cross-sectional views each showing the operation of the trigger;

FIGS. 6(A) and 6(B) are cross-sectional views each showing the operation of the trigger corresponding to a second mode;

FIG. 7 is a flowchart including an example of control performed by the driving tool;

FIGS. 8(A), 8(B) and 8(C) are cross-sectional views each showing the operation of the trigger;

FIGS. 9(A) and 9(B) are cross-sectional views each showing the operation of the trigger;

FIGS. 10(A), 10(B) and 10(C) are cross-sectional views each showing the operation of the trigger;

FIGS. 11(A) and 11(B) are cross-sectional views each showing the operation of the trigger;

FIGS. 12(A), 12(B) and 12(C) are cross-sectional views each showing the operation of the trigger;

FIGS. 13(A) and 13(B) are cross-sectional views each showing the operation of the trigger;

FIG. 14 is a flowchart including another example of control performed by the driving tool; and FIG. 15(A) is a longitudinal cross-sectional view showing another example of a power supply unit provided in the driving tool, and FIG. 15(B) is a side cross-sectional view taken along a line III-III in FIG. 15(A).

DETAILED DESCRIPTION OF PREFERRED EMBODIMENTS

Next, some driving tools included in embodiments of the present invention will be explained with reference to the drawings.

Figure 1:
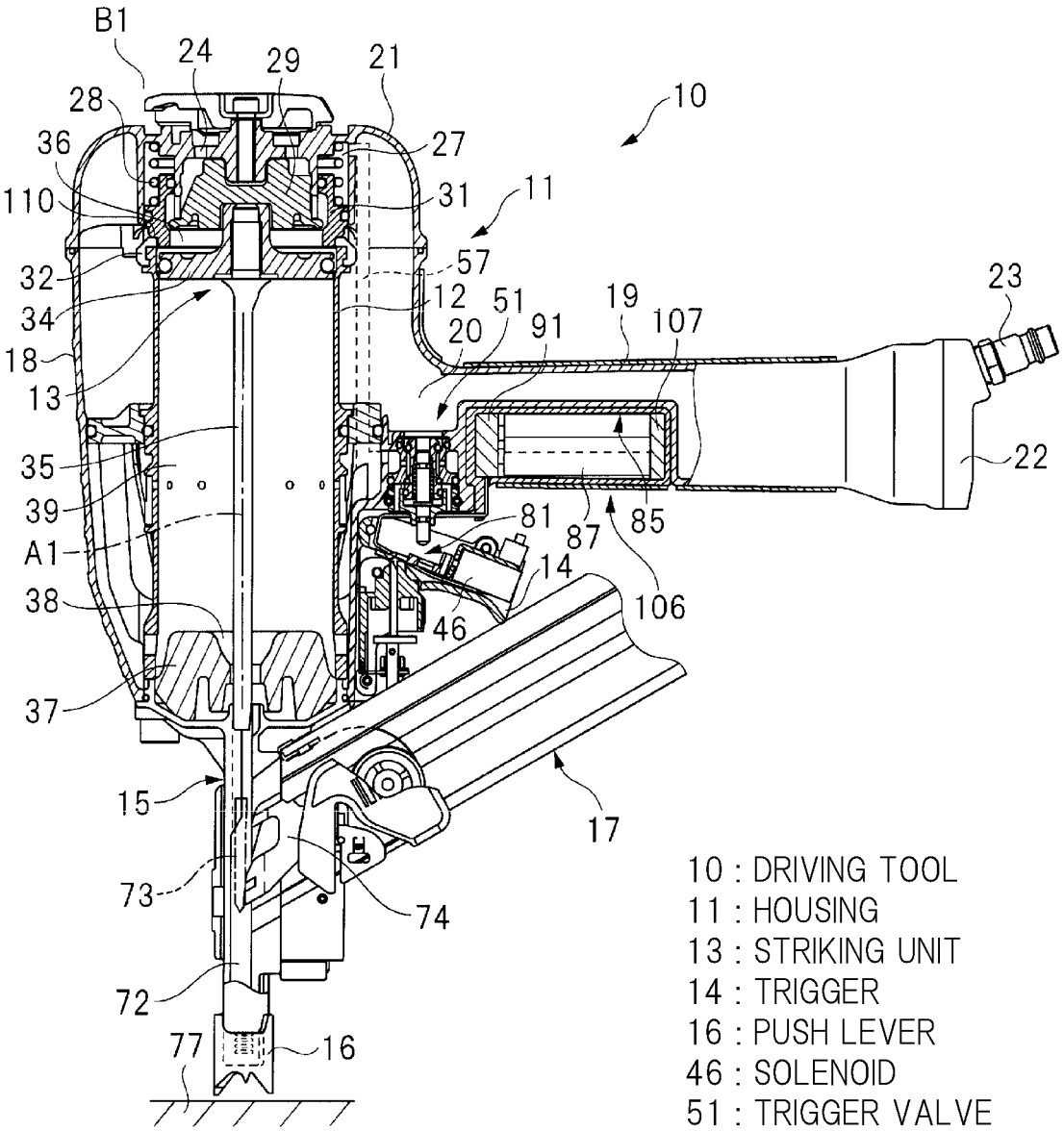
FIG. 1 is a front cross-sectional view showing the overall structure of a driving tool according to an embodiment of the present invention.
Figure 2:
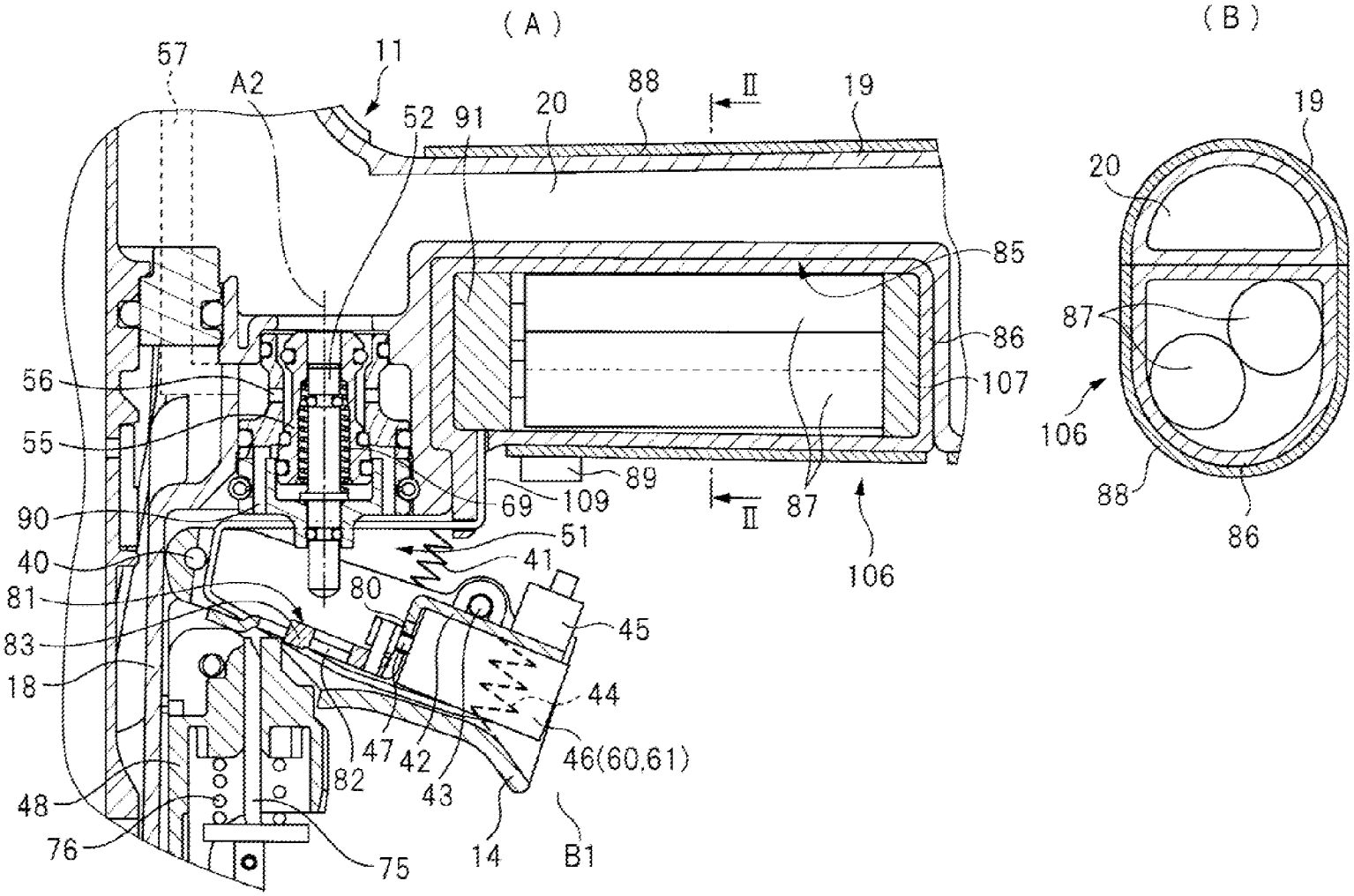
FIG. 2(A) is a cross-sectional view showing a trigger and a slide member provided in the driving tool.
FIG. 2(B) is a side cross-sectional view taken along a line II-II in FIG. 2A.

A driving tool 10 shown in FIGS. 1 and 2 includes a housing 11, a cylinder 12, a striking unit 13, a trigger 14, an injection unit 15, and a push lever 16. A magazine 17 is also attached to the driving tool 10. The housing 11 has a cylindrical main body 18, a head cover 21 fixed to the main body 18, and a handle 19 connected to the main body 18.

A pressure accumulation chamber 20 is formed over the inside of the handle 19, the inside of the main body 18 and the inside of the head cover 21. An end cover 22 is fixed to an end of the handle 19 opposite to the main body 18. A plug 23 is attached to the end cover 22. An air hose is connected to the plug 23. Compressed air as a compressible gas is supplied to the pressure accumulation chamber 20 through the air hose. The cylinder 12 is provided inside the main body 18. The head cover 21 has an exhaust passage 24. The exhaust passage 24 communicates with the outside B1 of the housing 11.

A head valve 31 is provided inside the head cover 21. The head valve 31 is movable in a direction of a center line A1 of the cylinder 12. A control chamber 27 is formed inside the head cover 21. An urging member 28 is provided in the control chamber 27. The urging member 28 is, for example, a compression coil spring made of metal. The urging member 28 urges, in the direction of the center line A1, the head valve 31 in a direction bringing it close to the cylinder 12. A stopper 29 is provided inside the head cover 21. To the cylinder 12, a valve seat 32 is attached at an end of a position closest to the head valve 31 in the direction of the center line A1.

The striking unit 13 has a piston 34 and a driver blade 35 fixed to the piston 34. The piston 34 is arranged inside the cylinder 12. The striking unit 13 can move in the direction of the center line A1, and then, stop. A seal member 30 is attached to an outer peripheral surface of the piston 34. A piston upper chamber 36 is formed between the stopper 29 and the piston 34. A passage 110 is formed between the head valve 31 and the valve seat 32.

When the head valve 31 is separated from the valve seat 32, the passage 110 is open, and the pressure accumulation chamber 20 is connected to the piston upper chamber 36. When the head valve 31 is pressed against the valve seat 32, the passage 110 is closed, and the pressure accumulation chamber 20 is disconnected from the piston upper chamber 36. The piston upper chamber 36 communicates with the outside B1 of the housing 11 through the exhaust passage 24.

The injection unit 15 is fixed to an end portion of the main body 18 opposite to a portion having the head cover 21 in the direction of the center line A1. The injection unit 15 has an injection path 72. The center line A1 is positioned inside the injection path 72, and the driver blade 35 is movable inside the injection path 72 in the direction of the center line A1.

A bumper 37 is provided inside the cylinder 12. The bumper 37 is arranged inside the cylinder 12 at a position closest to the injection unit 15 in the direction of the center line A1. The bumper 37 has a shaft hole 38, and the driver blade 35 is movable inside the shaft hole 38 in the direction of the center line A1. Inside the cylinder 12, a piston lower chamber 39 is formed between the piston 34 and the bumper 37.

A trigger valve 51 is provided at a connection point between the main body 18 and the handle 19. The trigger valve 51 has a plunger 52, a valve body 55, passages 56, 90, and an urging member 69. The plunger 52 can move in a direction of a center line A2, and then, stop. The center line A1 is parallel to the center line A2. The passage 56 is connected to the control chamber 27 through a passage 57. The passage 90 communicates with the outside B1 of the housing 11. The urging member 69 is, for example, a compression spring, and the urging member 69 urges the plunger 52 in a direction bringing it away from the pressure accumulation chamber 20 in the direction of the center line A2.

The magazine 17 is supported by the injection unit 15 and the handle 19. The magazine 17 houses a fastener 73. The magazine 17 has a feeder 74, and the feeder 74 feeds the fastener 73 inside the magazine 17 to an injection path 72.

As shown in FIG. 1, the push lever 16 is attached to the injection unit 15. The push lever 16 is operable with respect to the injection unit 15 and the housing 11 in the direction of the center line A1. As shown in FIG. 2, a holder 48 is provided in the main body 18, and a transmission member 75 is supported by the holder 48. The transmission member 75 is movable in the direction of the center line A2. An urging member 76 is provided between the holder 48 and the transmission member 75. The urging member 76 is, for example, a metal spring. The urging member 76 urges the transmission member 75 in a direction bringing it away from the trigger valve 51 in the direction of the center line A2.

As shown in FIG. 4(A), a mode selection member 84 is attached to the housing 11. The mode selection member 84 is movable within a predetermined angle range with respect to the housing 11. An operator operates the mode selection member 84 to rotate and stop the mode selection member. The mode selection member 84 is, for example, a lever or a knob. The operator selects either a first mode or a second mode as a mode for using the driving tool 10. Before using the driving tool 10, the operator stops the mode selection member 84 at a position corresponding to the first mode or a position corresponding to the second mode.

The first mode is a mode making the striking unit 13 move in a procedure in which the operator presses the push lever 16 against a workpiece 77 while the operator applies an operational force to the trigger 14. The second mode is a mode making the striking unit 13 move in a procedure in which the operator applies the operational force to the trigger 14 while the operator presses the push lever 16 against the workpiece 77.

The trigger 14 is attached to the mode selection member 84 through a support shaft 40. The support shaft 40 is arranged at a position eccentric from a rotation center of the mode selection member 84. When the operator rotates the mode selection member 84, the support shaft 40 moves in a direction intersecting the center line A2. The trigger 14 is also rotatable around the support shaft 40 within a predetermined angle range. An urging member 41 is provided, and the urging member 41 urges the trigger 14 clockwise in FIG. 4(A). The urging member 41 is, for example, a metal spring.

Figure 3:
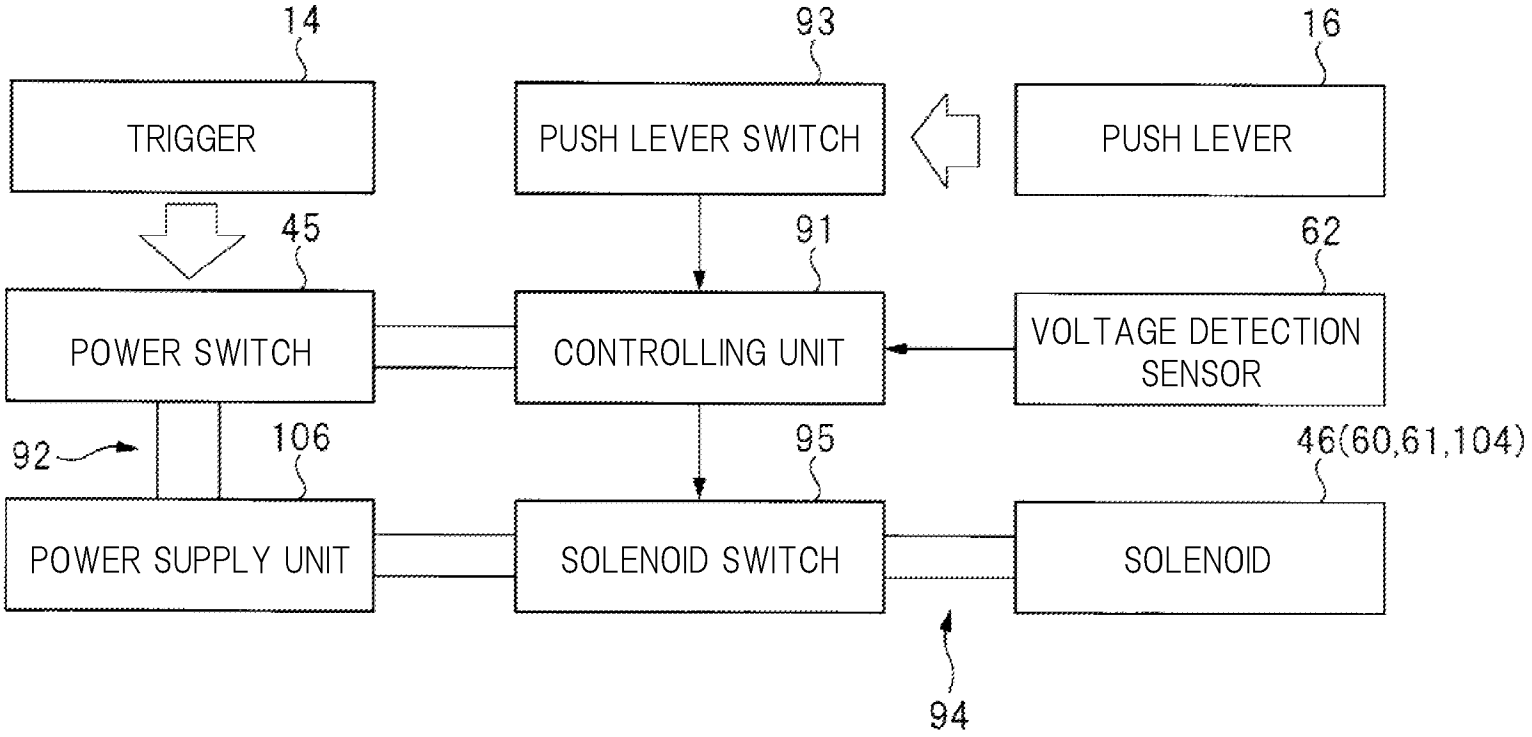
FIG. 3 is a block diagram showing a control unit system of the driving tool in FIG. 1.

A trigger arm 42 is attached to the trigger 14 through a support shaft 43. The trigger arm 42 is movable around the support shaft 43 within a predetermined angle range with respect to the trigger 14. The trigger 14 is provided with an urging member 44. The urging member 44 urges the trigger arm 42 counterclockwise with respect to the trigger 14. The urging member 44 is, for example, a metal spring. A part of the trigger 14 and a part of the trigger arm 42 are arranged between the trigger valve 51 and the holder 48 in the direction of the center line A2. A power switch 45 shown in FIG. 3 is attached to the trigger arm 42.

Specific Example 1 of Actuator and Slide Member

A solenoid 46 is attached to the trigger arm 42. The solenoid 46 shown in FIG. 4(A) is a specific example 1 of an actuator. The plunger 52 is arranged between the solenoid 46 and the main body 18 in a direction intersecting the center line A2. The solenoid 46 has a coil and a plunger 47. The plunger 47 can be brought close to and away from the plunger 52. The plunger 47 is made of a magnetic material such as iron. When electric current flows through the coil of the solenoid 46, the coil generates magnetic attraction force. The coil urges the plunger 47 in a direction bringing it away from the plunger 52 by the magnetic attraction force. The coil urges the plunger 47 rightward in FIG. 4(A).

An urging member 80 is provided on an outer periphery of the plunger 47. The urging member 80 urges the plunger 47 in the direction bringing it close to the plunger 52. The urging member 80 urges the plunger 47 leftward in FIG. 4(A). The urging member 80 is, for example, a metal spring. Assumed is that a movement force acting on the plunger 47 by the magnetic attraction force of the coil is larger than a movement force applied from the urging member 80 to the plunger 47.

The slide member 81 is fixed to the plunger 47. The slide member 81 has a contact portion 83 and a notch 82. The slide member 81 is guided by the trigger arm 42, and moves or stops together with the plunger 47. The solenoid 46 and the slide member 81 are arranged inside an arrangement region of the trigger 14 in a plane perpendicular to the support shaft 40.

As shown in FIGS. 1, 2(A), and 2(B), the power supply unit 106 is attached to the housing 11, for example, to the handle 19. A concave portion 85 is provided on an outer surface of the handle 19 between the trigger valve 51 and the end cover 22. The concave portion 85 is provided in a portion of the handle 19 close to the magazine 17 in the direction of the center line A2. The power supply unit 106 is arranged in the concave portion 85.

The power supply unit 106 has an enclosure 86 and a battery cell 87. The enclosure 86 is made of an insulating material such as a synthetic resin. The enclosure 86 can come in and out of the concave portion 85. The battery cell 87 is housed in the enclosure 86. The battery cell 87 has a cylindrical shape, and a plurality of battery cells 87 are arranged in a radial direction. The battery cell 87 is a chargeable/dischargeable secondary battery. As the battery cell 87, any one of a lithium-ion battery, a nickel hydrogen battery, a lithium-ion polymer battery, and a nickel cadmium battery can be used. The battery cell may be a primary battery. Further, the power supply unit 106 has a power cable 109 for supplying power to the solenoid 46.

A grip 88 covers outer surfaces of the handle 19 and the power supply unit 106. The grip 88 is made of, for example, a synthetic rubber, and has a cylindrical shape. When the grip 88 covers the outer surfaces of the handle 19 and the power supply unit 106, the power supply unit 106 does not fall off from the concave portion 85. When the operator detaches the grip 88 from the handle 19, the power supply unit 106 can come in and out of the concave portion 85.

A protrusion 89 is provided on an outer surface of the enclosure 86. When the power switch 45 contacts the protrusion 89, the power switch 45 is turned ON. When the power switch 45 is away from the protrusion 89, the power switch 45 is turned OFF.

FIG. 3 is a block diagram showing a control system of the driving tool 10. A control unit 91 and a terminal 107 are provided inside the enclosure 86. The terminals 107 are electrically connected to the plurality of battery cells 87, respectively. The control unit 91 is a microcomputer having an input interface, an output interface, an arithmetic processing unit, a memory, and a timer. An electric circuit 92 is provided between the control unit 91 and the power supply unit 106.

The turning ON of the power switch 45 is to connect the electric circuit 92. The turning OFF of the power switch 45 is to disconnect the electric circuit 92. When the power switch 45 is turned ON, the power of the power supply unit 106 is supplied to the control unit 91, and the control unit 91 is activated. When the power switch 45 is turned OFF, the power of the power supply unit 106 is not supplied to the control unit 91, and the control unit 91 stops. A push lever switch 93 is provided in the injection unit 15.

When the operator presses the push lever 16 against the workpiece 77, the transmission member 75 which is provided on the push lever 16 is brought close to the trigger valve 51. When the operator brings the push lever 16 away from the workpiece 77, the transmission member 75 is brought away from the trigger valve 51. An electric circuit 94 is provided between the power supply unit 106 and the solenoid 46. A solenoid switch 95 for connecting and disconnecting the electric circuit 94 is provided.

The control unit 91 turns ON and OFF the solenoid switch 95. The turning ON of the solenoid switch 95 is to connect the electric circuit 94. The turning OFF of the solenoid switch 95 is to disconnect the electric circuit 94. A voltage detection sensor 62 for detecting a voltage of the power supply unit 106 is provided. A signal from the voltage detection sensor 62 is input to the control unit 91.

Next, a usage example of the driving tool 10 will be explained with reference to the flowchart in FIG. 7.

(Example of Operator's Selection for First Mode)

When the operator operates the mode selection member 84 to stop the mode selection member 84 at the position corresponding to the first mode, the trigger 14 is closest to the main body 18 in the direction intersecting the center line A2 as shown in FIG. 4(A). The trigger arm 42 is closest to the support shaft 40 in the direction intersecting the center line A2.

A state in which the operator releases the operational force from the trigger 14 and brings the push lever 16 away from the workpiece 77 is an initial state of the driving tool 10 in a step S10 in FIG. 7. The trigger 14 is brought into contact with the holder 48, and the trigger 14 and the trigger arm 42 stop at their respective initial positions. The push lever 16 also stops at the initial position, and the push lever switch 93 is turned OFF. When the trigger 14 stops at the initial position, the power switch 45 is turned OFF. Thus, the power of the power supply unit 106 is not supplied to the control unit 91, and the control unit 91 stops.

The solenoid switch 95 is turned OFF, and the power of the power supply unit 106 is not supplied to the solenoid 46. Therefore, the plunger 47 stops at the initial position, and the slide member 81 stops at the initial position. The initial position of the plunger 47 is a position closest to the plunger 52. The initial position of the slide member 81 is a position at which the slide member 81 is closest to the transmission member 75 in the moving direction of the slide member 81. In other words, the plunger 47 stops at the position closest to the transmission member 75 by the force of the urging member 80.

The trigger valve 51 stops in a standby state. In the standby state of the trigger valve 51, the pressure accumulation chamber 20 and the passage 56 are connected to each other, and the compressed air is supplied to the control chamber 27. Thus, the head valve 31 is pressed against the valve seat 32. Therefore, the pressure accumulation chamber 20 and the piston upper chamber 36 are disconnected from each other, and the striking unit 13 stops at the initial position shown in FIG. 1, that is, at the top dead center.

When the operator applies the operational force to the trigger 14, the trigger 14 moves counterclockwise in FIG. 4(A), and the power switch 45 is turned ON as in FIG. 4(B), and the trigger 14 stops at a movement position. In a step S11, when the power switch 45 is turned ON, the power of the power supply unit 106 is supplied to the control unit 91, and the control unit 91 is activated. The control unit 91 starts the timer, and turns ON the solenoid switch 95. The power of the power supply unit 106 is supplied through the power cable 109 to the solenoid 46, and the coil generates the magnetic attraction force.

The slide member 81 moves from the initial position shown in FIG. 4(B) to the movement position shown in FIG. 4(C), and then, stops. The movement position of the slide member 81 is at position at which the slide member 81 is farthest away from the transmission member 75 in the moving direction of the slide member 81.

In a step S13, the control unit 91 determines whether the push lever switch 93 has been turned ON within a predetermined time from the start of the timer. The predetermined time is, for example, three seconds. If the control unit 91 determines "Yes" in the step S13, the control unit 91 resets the timer in a step S14, and turns OFF the solenoid switch 95. Thus, the power of the power supply unit 106 is not supplied to the solenoid 46.

A movement force of the push lever 16 is transmitted to the trigger arm 42 through the transmission member 75. The trigger arm 42 moves clockwise around the support shaft 43 in FIG. 4(A), and the power switch 45 is turned OFF as shown in FIG. 5(A). When the power switch 45 is turned OFF in the step S14, the power of the power supply unit 106 is not supplied to the control unit 91, and the control unit 91 stops.

Further, when the trigger arm 42 moves clockwise, the contact portion 83 of the slide member 81 is pressed against the plunger 52 of the trigger valve 51 as shown in FIG. 5(A). In this manner, the trigger valve 51 is switched from the standby state to the movement state. When the trigger valve 51 is in the movement state, the pressure accumulation chamber 20 and the passage 56 are disconnected from each other, and the passage 56 and the passage 90 are connected to each other. Thus, the compressible gas in the control chamber 27 is discharged to the outside B1 through the passage 90. The head valve 31 is brought away from the valve seat 32, and the pressure accumulation chamber 20 communicates with the piston upper chamber 36. As a result, the compressible gas in the pressure accumulation chamber 20 is supplied to the piston upper chamber 36, the striking unit 13 moves from the top dead center to the bottom dead center, and the driver blade 35 strikes the fastener 73. The fastener 73 is driven into the workpiece 77 in the step S14.

Further, when the operator presses the push lever 16 against the workpiece 77, the transmission member 75 is pressed against the plunger 52 as shown in FIG. 5(A). Thus, in a state in which the power of the power supply unit 106 is not supplied to the solenoid 46, the slide member 81 is stopped at the movement position by a frictional force at the contact point between the slide member 81 and the plunger 52.

When the operator keeps the state of the application of the operational force on the trigger 14 and brings the push lever 16 away from the workpiece 77, the push lever switch 93 is turned OFF in a step S15. Further, the transmission member 75 returns from the movement position to the initial position, and then, stops. The trigger arm 42 is moved counterclockwise by the force of the urging member 44, and then, stops, and the power switch 45 is turned ON in the step S15.

In the step S15, when the power switch 45 is turned ON, the power of the power supply unit 106 is supplied to the control unit 91, and the control unit 91 is activated. Further, the control unit 91 starts the timer in the step S15 and turns ON the solenoid switch 95. Thus, the power of the power supply unit 106 is supplied to the solenoid 46, and the slide member 81 moves from the initial position to the movement position, and then, stops. The trigger valve 51 returns from the movement state to the standby state in the step S15. A procedure for the control unit 91 proceeds to the step S15 followed by the step S12.

On the other hand, if the control unit 91 determines "No" in the step S13, the solenoid switch 95 is turned OFF and the timer is reset in a step S16. Thus, the power of the power supply unit 106 is not supplied to the solenoid 46, and the solenoid 46 returns to the initial position, and then, stops. In other words, the plunger 47 is moved by the force of the urging member 80, and the plunger 47 stops at the position closest to the transmission member 75. The slide member 81, together with the plunger 47, returns from the movement position shown in FIG. 4(C) to the initial position shown in FIG. 4(B), and then, stops.

Here, when the push lever 16 is brought into contact with a foreign matter other than the workpiece 77 to move the transmission member 75 so that the trigger arm 42 moves clockwise in FIG. 4(B), the plunger 52 enters the notch 82 as shown in FIG. 5(B). Thus, the movement force of the trigger arm 42 is not transmitted to the trigger valve 51, and the trigger valve 51 remains in the standby state.

As described above, even if the push lever 16 is brought into contact with the foreign matter after a predetermined time from the application of the operational force to the trigger 14, the trigger valve 51 is maintained in the standby state, and the striking unit 13 stops at the top dead center. Therefore, the fastener 73 can be prevented from being driven into the foreign matter.

The control unit 91 determines whether the power switch 45 is turned OFF in a step S17 following the step S16. The control unit 91 repeats the determination in the step S17 if the control unit determines "No" in the step S17. When the control unit 91 determines "Yes" in the step S17, the procedure for the control unit proceeds to the step S10.

In the driving tool 10 of the present embodiment, to the plunger 52 of the trigger valve 51, the slide member 81 transmits the movement force transmitted from the push lever 16 to the trigger arm 42. The solenoid 46 making the slide member 81 move and stop is provided on the trigger 14. Therefore, it is unnecessary to provide an exclusive-use space for arranging the solenoid 46.

Specific Example 2 of Actuator and Slide Member

In order to move and stop the slide member 81, a solenoid 60 is provided in place of the solenoid 46. The solenoid 60 is a specific example 2 of the actuator, and the solenoid 60 has a coil and a plunger 47. The supply of electric current to the solenoid generates an attraction force, but cannot move the plunger 47 and the slide member 81 so as to be against the force of the urging member 80. In other words, the solenoid 60 is an electromagnet. The plunger 52 is arranged between the solenoid 60 and the main body 18 in the direction intersecting the center line A2.

Since the solenoid 60 is provided, the plunger 47 and the slide member 81 stop at the initial position even if the power is supplied to the solenoid 60 in the step S11 in FIG. 7. In the step S12, the operator manually moves the plunger 47 and the slide member 81 from the initial position to the movement position. In this manner, the solenoid 60 keeps the plunger 47 and the slide member 81 at the movement position.

Further, even if the power is supplied to the solenoid 60 in the step S15, the plunger 47 and the slide member 81 stop at the initial position. In the step S15, the operator manually moves the plunger 47 and the slide member 81 from the initial position to the movement position. In this manner, the solenoid 60 holds the plunger 47 and the slide member 81 at the movement position, and the procedure proceeds to the step S12. Other controls in the case of the usage of the solenoid 60 are the same as other controls corresponding to the flowchart in FIG. 7.

Specific Example 3 of Actuator and Slide Member

In order to move and stop the slide member 81, a keep solenoid 61 is provided in place of the solenoid 46. The keep solenoid 61 is a specific example 3 of the actuator, and the keep solenoid 61 has a coil and a permanent magnet. In this case, the urging member 80 is not provided. The solenoid switch 95 can be turned ON and OFF, and the direction of the electric current supplied to the keep solenoid 61 can be switched. When power is supplied from the power supply unit 106 to the keep solenoid 61, the plunger 47 is moved.

When the direction of the electric current supplied to the keep solenoid 61 is switched, a direction of the movement of the plunger 47 is switched. When the supply of the power from the power supply unit 106 to the keep solenoid 61 stops, the plunger 47 is stopped at the initial position or the movement position by an attraction force of the permanent magnet. The plunger 52 is arranged between the keep solenoid 61 and the main body 18 in a direction intersecting with the center line A2.

An example of control in a case of usage of the keep solenoid 61 will be explained with reference to the flowchart in FIG. 7. In the step S10, no power is supplied to the keep solenoid 61, and the plunger 47 stops at the initial position. In the step S11, the control unit 91 turns ON the solenoid switch 95 to supply the power to the keep solenoid 61. A direction of the electric current supplied to the keep solenoid 61 is the direction in which the slide member 81 moves from the initial position to the movement position in the step S12. In the step S12, the control unit 91 stops the supply of the power to the keep solenoid 61, and the slide member 81 stops at the movement position.

When the control unit 91 determines "Yes" in the step S13, the procedure proceeds through the step S14 to the step S15, and the power is supplied to the keep solenoid 61. Thus, the slide member 81 returns from the movement position to the initial position. The procedure in the control unit 91 proceeds from the step S15 to the step S12, and the power is supplied to the keep solenoid 61 and stops. Thus, the slide member 81 moves from the initial position to the movement position, and then, stops at the movement position.

If the control unit 91 determines "No" in the step S13, the control unit 91 supplies and stops the power to the keep solenoid 61 in the step S16. Thus, the slide member 81 moves from the movement position to the initial position, and then, stops at the initial position. Other controls in the case of the usage of the keep solenoid 61 are the same as other controls corresponding to the flowchart in FIG. 7.

(Example of Operator's Selection for Second Mode)

First, an example with the solenoid 46 will be explained. When the operator stops the mode selection member 84 at a position corresponding to the second mode, the trigger 14 and the trigger arm 42 stop at a position farthest away from the main body 18 in the direction intersecting the center line A2 as shown in FIG. 6(A). In an initial state in which the operator releases the operational force from the trigger 14 and brings the push lever 16 away from the workpiece 77, the power switch 45 is turned OFF and the solenoid switch 95 is turned OFF. The power is not supplied to the solenoid 46, and the slide member 81 stops at the initial position. Further, the trigger valve 51 stops in the standby state, and the compressed air in the pressure accumulation chamber 20 is not supplied to the piston upper chamber 36. Thus, the striking unit 13 stops at the initial position, that is, at the top dead center.

When the operator presses the push lever 16 against the workpiece 77 without applying the operational force to the trigger 14, the transmission member 75 moves. The movement force of the transmission member 75 is not transmitted to the plunger 52. When the operator applies the operational force to the trigger 14 while pressing the push lever 16 against the workpiece 77, the trigger 14 moves counterclockwise in FIG. 6(A). In this manner, although the trigger 14 reaches and then stops at the movement position, the power switch 45 remains turned OFF.

Further, the trigger arm 42 moves counterclockwise, and the contact portion 83 of the slide member 81 is pressed against the plunger 52 as shown in FIG. 6(B). Thus, the trigger valve 51 is switched from the standby state to the movement state, and the striking unit 13 moves from the top dead center to the bottom dead center. Further, when the operator brings the push lever 16 away from the workpiece 77 and releases the operational force from the trigger 14, the trigger valve 51 is switched from the movement state to the standby state. The trigger 14 returns from the movement state to the initial state shown in FIG. 6(A), and then, stops.

When the operator selects the second mode and when the operator applies the operational force to the trigger 14 while brings the push lever 16 away from the workpiece 77, the trigger moves counterclockwise, and then, stops at the movement position. However, the power switch 45 remains turned OFF. Further, the entire trigger arms 42 stop outside the movement range of the transmission member 75. Thus, even if the operator presses the push lever 16 against the workpiece 77 while applying the operational force to the trigger 14, the movement force of the transmission member 75 is not transmitted to the trigger arm 42. In other words, the trigger valve 51 remains in the standby state, and the striking unit 13 stops at the top dead center.

Even when the solenoid 60 is provided in place of the solenoid 46, the power of the power supply unit 106 is not supplied to the solenoid 60, and the slide member 81 stops at the initial position. Further, even when the keep solenoid 61 is provided in place of the solenoid 46, the power of the power supply unit 106 is not supplied to the keep solenoid 61, and the slide member 81 stops at the initial position.

Specific Example 4 of Actuator and Slide Member

The solenoid 46 shown in FIG. 8(A) is a specific example 4 of the actuator. The same components shown in FIG. 8(A) as the components shown in FIG. 2 are denoted by the same reference symbols as those in FIG. 2. The solenoid 46 is arranged between the plunger 52 and the main body 18 in the direction intersecting the center line A2 in FIG. 8(A). When an electric current is supplied to the coil of the solenoid 46, the plunger 47 is brought close to the plunger 52. In other words, the solenoid 46 urges the plunger 47 leftward in FIG. 8(A). The urging member 80 urges the plunger 47 so as to bring it away from the plunger 52. In other words, the urging member 80 urges the plunger 47 rightward in FIG. 8(A).

When the operator selects the first mode and releases the operational force to the trigger 14 and the push lever 16 shown in FIG. 1 is separated from the workpiece 77, the trigger 14, the trigger arm 42 and the trigger valve 51 are in the initial state shown in FIG. 8(A). In other words, the power switch 45 is turned OFF, and the push lever switch 93 is turned OFF.

When the operator selects the first mode, applies the operational force to the trigger 14, and brings the push lever 16 away from the workpiece 77, the power switch 45 is turned ON as shown in FIG. 8(B). The electric current is supplied to the solenoid 46, and the slide member 81 moves from the initial position to the movement position, and then, stops. Further, the push lever switch 93 is turned OFF.

When the push lever 16 is pressed against the workpiece 77 within a predetermined time from the operator's selection for the first mode and the application of the operational force to the trigger 14, the transmission member 75 moves to the movement position, and then, stops as shown in FIG. 8(C). The movement force of the transmission member 75 is transmitted to the plunger 52 through the trigger arm 42 and the slide member 81, and the trigger valve 51 is switched from the standby state to the movement state. Therefore, the striking unit 13 shown in FIG. 1 moves from the top dead center to the bottom dead center.

On the other hand, after the predetermined time in the state of the push lever 16 away from the workpiece 77 has elapsed from the operator's selection for the first mode and the application of the operational force to the trigger 14, the supply of the electric current to the solenoid 46 stops, and the slide member 81 moves from the movement position to the initial position shown in FIG. 9(A), and then, stops at the initial position.

Thus, after the predetermined time in the state of the push lever 16 away from the workpiece 77 has elapsed from the operator's selection for the first mode and the application of the operational force to the trigger 14, if the push lever 16 is brought into contact with the foreign matter while the transmission member 75 moves, the plunger 52 enters the notch 82 of the slide member 81 as shown in FIG. 9(B). Thus, the trigger valve 51 remains in the standby state, and the striking unit 13 stops at the top dead center.

When the arrangement structure of the solenoid 46 and the slide member 81 shown in FIG. 8(A) is provided in the driving tool 10 shown in FIG. 1, the control example in FIG. 7 is applied. Further, the solenoid 60 or the keep solenoid 61 can be provided in place of the solenoid 46 shown in FIG. 8(A). Even when the solenoid 60 or the keep solenoid 61 is provided in place of the solenoid 46 shown in FIG. 8(A), the control example in FIG. 7 is applied.

When the solenoid 46 shown in FIG. 8(A), the solenoid 60 or the keep solenoid 61 is provided, if the operator selects the second mode, the action and the control of the driving tool 10 having the solenoid 46 shown in FIG. 2 are the same as those when the operator selects the second mode, except that the movement directions of the plunger 47 and the slide member 81 are reversed.

Specific Example 5 of Actuator and Slide Member

Another example of a mechanism for operating the slide member 81 is shown in FIG. 10(A). The support shaft 40 shown in FIG. 10(A) is attached to the housing 11. The mode selection member 84 shown in FIG. 2 is not provided in FIG. 10(A). In FIG. 10(A), components similar to those in FIGS. 2 and 4(A) are denoted by the same reference symbols as those in FIGS. 2 and 4(A). The trigger 14 is attached to the housing 11 through the support shaft 40. The mode selection member 84 is not provided.

A solenoid 104 is attached to the trigger arm 42. The solenoid 104 has a coil and a plunger 47. An urging member 105 is attached to the plunger 47. The urging member 105 urges the plunger 47 in a direction bringing it away from the plunger 52, that is, rightward in FIG. 10(A). The urging member 105 is made of, for example, metal. The slide member 81 is fixed to the plunger 47. When the plunger 47 moves, the slide member 81 moves with respect to the trigger arm 42.

When the supply of the electric current to the solenoid 104 stops, the plunger 47 is stopped at the initial position farthest from the plunger 52 by the urging force of the urging member 105. When the electric current is supplied to the solenoid 104, the plunger 47 moves in a direction bringing it close to the plunger 52 against the urging force of the urging member 105, that is, leftward in FIG. 10(A), and then, the plunger 47 stops at the movement position. When the supply of the electric current to the solenoid 104 stops while the plunger 47 stops at the movement position, the plunger 47 is moved in a direction bringing it away from the plunger 52 by the urging force of the urging member 105, and the plunger 47 stops at the initial position.

The driving tool 10 having the solenoid 104 can be controlled by the control system in FIG. 3. When the control unit 91 turns ON the solenoid switch 95, the electric current is supplied to the solenoid 104. When the control unit 91 turns OFF the solenoid switch 95, the supply of the electric current to the solenoid 104 stops.

(Example of Operator's Selection for First Mode)

A state in which the operator releases the operational force from the trigger 14 and the operator brings the push lever 16 away from the workpiece 77 is the initial state of the driving tool 10 shown in FIG. 10(A). The power switch 45 is turned OFF. Thus, the power of the power supply unit 106 is not supplied to the control unit 91, and the control unit 91 stops.

The power of the power supply unit 106 is not supplied to the solenoid 104, and the plunger 47 stops at the initial position. Further, the trigger valve 51 stops in the standby state. Therefore, the striking unit 13 stops at the top dead center shown in FIG. 1.

When the operator applies the operational force to the trigger 14 as shown in FIG. 10(B) and stops the trigger 14, the power switch 45 is turned ON. When the power switch 45 is turned ON, the control unit 91 is activated, and the control unit 91 starts the timer. The power of the power supply unit 106 is supplied to the solenoid 104, and the plunger 47 moves from the initial position, and stops at the movement position shown in FIG. 10(B). The slide member 81, together with the plunger 47, moves from the initial position to the movement position, and then, stops. An end of the slide member 81 being stopping at the movement position is positioned within the movement range of the transmission member 75.

When the operator presses the push lever 16 against the workpiece 77 within a predetermined time from the start of the timer by the control unit 91, the transmission member 75 is pressed against the slide member 81 as shown in FIG. 10(C). Thus, the trigger arm 42 moves clockwise with respect to the trigger 14, and the movement force of the trigger arm 42 is transmitted to the plunger 52 through the slide member 81. Therefore, the trigger valve 51 is switched from the standby state to the movement state. The striking unit 13 shown in FIG. 1 moves from the top dead center to the bottom dead center.

Further, the power switch 45 is turned OFF as shown in FIG. 10(C), the control unit 91 resets the timer, the control unit 91 stops, and the supply of electric current to the solenoid 104 stops.

Here, the slide member 81 is pressed against the plunger 52. Thus, although the supply of electric current to the solenoid 104 stops, the slide member 81 is stopped at the movement position by the frictional force at the contact point between the slide member 81 and the plunger 52.

When the operator brings the push lever 16 away from the workpiece 77 while keeping applying the operational force to the trigger 14, the push lever switch 93 is turned OFF. The transmission member 75 returns from the movement position to the initial position, and then, stops. The trigger valve 51 returns from the movement state to the standby state, and the striking unit 13 returns from the bottom dead center to the top dead center, and then, stops. The plunger 47 and the slide member 81 return from the movement position to the initial position, and then, stop. Further, the trigger arm 42 moves counterclockwise, and then, stops, and the power switch 45 is turned ON.

When the power switch 45 is turned ON, the control unit 91 is activated, and the timer is started. The electric current is supplied to the solenoid 104. Thus, the plunger 47 and the slide member 81 move from the initial position to the movement position, and then, stop.

When a predetermined time elapses from the start of the timer by the control unit 91, the control unit 91 stops the supply of the electric current to the solenoid 104. Thus, the plunger 47 moves rightward in FIG. 10(B), and then, stops at the initial position shown in FIG. 11(A). The entire slide member and the entire trigger arm 42 are positioned outside the movement range of the transmission member 75.

Here, even when the push lever 16 is brought into contact with the foreign matter other than the workpiece 77 and when the transmission member 75 moves, the transmission member 75 is not brought into contact with both the slide member 81 and the trigger arm 42 as shown in FIG. 11(B). In other words, the movement force of the transmission member 75 is not transmitted to the trigger valve 51, and the trigger valve 51 remains in the standby state. As described above, the driving tool 10 having the solenoid 104 in FIG. 10(A) can perform the control shown in FIG. 7.

(Example of Operator's Selection for Second Mode)

In a case in which the driving tool 10 is in the initial state shown in FIG. 10(A), when the operator does not apply the operational force to the trigger 14 but presses the push lever 16 against the workpiece 77, the transmission member 75 moves. The push lever switch 93 is turned ON. The movement force of the transmission member 75 is transmitted to the trigger arm 42, and the trigger arm 42 moves clockwise. However, the movement force of the trigger arm 42 is not transmitted to the plunger 52.

When the operator applies the operational force to the trigger 14 while pressing the push lever 16 against the workpiece 77, the trigger 14 moves counterclockwise, and then, the trigger 14 stops. Then, the power switch 45 is turned ON, and the control unit 91 is activated. The push lever switch 93 is turned ON at the time of the activation of the control unit 91, and therefore, the control unit 91 does not supply the electric current to the solenoid 104. Thus, the slide member 81 stops at the initial position.

The trigger arm 42 moves clockwise together with the trigger 14, and the slide member 81 is pressed against the plunger 52. At this time, the trigger arm 42 rotates around the support shaft 43, and the end 110 of the slide member 81 is positioned within the movement range of the transmission member 75. Therefore, the slide member 81 and the transmission member 75 remain in an engaged state.

Thus, the trigger valve 51 is switched from the standby state to the movement state, and the striking unit 13 moves from the top dead center to the bottom dead center. Further, when the operator brings the push lever 16 away from the workpiece 77 and releases the operational force to the trigger 14, the trigger valve 51 is switched from the movement state to the standby state. The trigger 14 returns from the movement state to the initial state, and then, stops.

Specific Example 6 of Actuator and Slide Member

Another example of the solenoid and the slide member will be explained with reference to FIG. 12(A). The same components shown in FIG. 12(A) as the components shown in FIGS. 2(A) and 4(A) are denoted by the same reference symbols as those in FIGS. 2(A) and 4(A).

The solenoid 60 is attached to the trigger arm 42. The slide member 81 has a protrusion 108. Further, the driving tool having the mechanism shown in FIG. 12(A) has the control system shown in FIG. 3.

(Example of Operator's Selection for First Mode)

An example of the operator's selection for the first mode will be explained with reference to the flowchart in FIG. 14. The operator operates the mode selection member 84 to stop the mode selection member 84 at the position corresponding to the first mode. A state in which the operator releases the operational force from the trigger 14 and brings the push lever 16 away from the workpiece 77 is the initial state of the driving tool 10 in a step S20. The protrusion 108 is engaged with the holder 48 to stop the slide member 81. The slide member 81 stops against the force of the urging member 80. Further, the power switch 45 is turned OFF. Thus, the control unit 91 stops, and the supply of the power to the solenoid 60 stops.

The trigger valve 51 stops in the standby state. Therefore, the pressure accumulation chamber 20 and the piston upper chamber 36 are disconnected from each other, and the striking unit 13 stops at the initial position shown in FIG. 1, that is, at the top dead center. At this time, the protrusion 108 of the slide member 81 often runs on and end 111 of the holder 48. In this case, the slide member 81 is set to the initial position so that the protrusion 108 is positioned on a side of the end 111 shown in FIG. 12(A).

Accordingly, when the operator applies the operational force to the trigger 14, the trigger 14 moves counterclockwise in FIG. 12(A), the power switch 45 is turned ON, and the trigger 14 stops at the movement position. In a step S21, when the power switch 45 is turned ON, the control unit 91 is activated. Since the protrusion 108 is released from the holder 48, the slide member 81 is moved by the force of the urging member 80, and the slide member 81 stops at the initial position shown in FIG. 12(B).

Once the operator releases the operational force from the trigger 14 in a step S22, the trigger 14 moves clockwise in FIG. 12(B), and the power switch 45 is turned OFF. When the protrusion 108 is engaged with the holder 48, the slide member 81 moves from the initial position to the movement position against the force of the urging member 80, and the slide member 81 stops at the movement position. Further, the control unit 91 releases the operational force from the trigger 14 in the step S22 and supplies the power to the solenoid 60 for a certain period of time from the time of the turning OFF of the power switch 45, and thus, the solenoid 60 maintains the attraction force for a certain period of time.

In a step S23, when the operator applies the operational force to the trigger 14, the protrusion 81 is released from the holder 48. The solenoid 60 keeps the slide member 81 to be at the movement position. When the trigger 14 moves, the power switch 45 is turned ON as shown in FIG. 12(C). Thus, the control unit 91 is activated, and the control unit 91 starts the timer in the step S23.

In a step S24, the control unit 91 determines whether the push lever switch 93 is turned ON within a predetermined time from the start of the timer. When the control unit 91 determines "Yes" in the step S24, the control unit 91 resets the timer in a step S25. The movement force of the push lever 16 is transmitted through the transmission member 75 to the trigger arm 42. The trigger arm 42 moves clockwise in FIG. 12(C), and the power switch 45 is turned OFF in the step S25. When the power switch 45 is turned OFF, the control unit 91 stops.

Further, when the trigger arm 42 moves clockwise, the contact portion 83 of the slide member 81 is pressed against the plunger 52 of the trigger valve 51 as shown in FIG. 13(A). In this manner, the trigger valve 51 is switched from the standby state to the movement state. Therefore, the striking unit 13 moves from the top dead center to the bottom dead center.

When the operator brings the push lever 16 away from the workpiece 77 while keeping the state of the application of the operational force to the trigger 14, the push lever switch 93 is turned OFF in a step S26. The transmission member 75 returns from the movement position to the initial position, and then, stops. The trigger arm 42 moves counterclockwise and stops at the initial position, and the power switch 45 is turned ON in the step S26. When the power switch 45 is turned ON, the control unit 91 is activated. The control unit 91 starts the timer in the step S26, and the procedure proceeds to the step S24.

On the other hand, if the control unit 91 determines "No" in the step S24, the control unit stops the supply of the power to the solenoid 60 in a step S27. In this manner, the slide member 81 is moved from the movement position shown in FIG. 12(C) by the force of the urging member 80, and the slide member 81 stops at the initial position shown in FIG. 12(B).

In a state in which the operational force is applied to the trigger 14 and in which the slide member 81 stops at the initial position, when the push lever 16 is brought into contact with the foreign matter other than the workpiece 77, the transmission member 75 moves, and the trigger arm 42 moves clockwise in FIG. 12(B). In this manner, the plunger 52 enters the notch 82 as shown in FIG. 13(B). Thus, the movement force of the trigger arm 42 is not transmitted to the trigger valve 51, and the trigger valve 51 remains in the standby state.

As described above, even if the push lever 16 is brought into contact with the foreign matter after a predetermined time has elapsed from the application of the operational force to the trigger 14, the trigger valve 51 remains in the standby state, and the striking unit 13 stops at the top dead center. Therefore, the fastener 73 can be prevented from being driven into the foreign matter.

The control unit 91 determines whether the power switch 45 is turned OFF in a step S28 following the step S27. If the control unit 91 determines "No" in the step S28, the control unit 91 repeats the determination in the step S28. When the control unit 91 determines "Yes" in the step S28, the procedure proceeds to the step S23.

(Example of Operator's Selection for Second Mode)

In the driving tool 10 having the mechanism shown in FIG. 12(A), when the operator operates the mode selection member 84 to select the second mode, the driving tool 10 becomes in the following state. The trigger 14 and the trigger arm 42 stop at a position farthest away from the main body 18 in the direction intersecting the center line A2. The protrusion 108 is away from the holder 48.

In an initial state in which the operator releases the operational force from the trigger 14 and brings the push lever 16 away from the workpiece 77, the power switch 45 is turned OFF, and no power is supplied to the solenoid 46. The slide member 81 is urged by the urging force of the urging member 80, and the slide member 81 stops at the initial position. The trigger valve 51 stops in the standby state, and the compressed air in the pressure accumulation chamber 20 is not supplied to the piston upper chamber 36. Thus, the striking unit 13 stops at the initial position, that is, at the top dead center. When the operator presses the push lever 16 against the workpiece 77 without applying the operational force to the trigger 14, the transmission member 75 moves. The movement force of the transmission member 75 is transmitted to the trigger arm 42, and the trigger arm 42 moves clockwise. However, the movement force of the trigger arm 42 is not transmitted to the plunger 52.

When the operator applies the operational force to the trigger 14 while pressing the push lever 16 against the workpiece 77, the trigger 14 moves counterclockwise. In this manner, although the trigger 14 reaches the movement position, and then, stops, the power switch 45 remains turned OFF. The trigger arm 42 moves counterclockwise, and the contact portion 83 of the slide member 81 is pressed against the plunger 52. Thus, the trigger valve 51 is switched from the standby state to the movement state, and the striking unit 13 moves from the top dead center to the bottom dead center.

Further, when the operator brings the push lever 16 away from the workpiece 77 and releases the operational force from the trigger 14, the trigger valve 51 is switched from the movement state to the standby state. The trigger 14 returns from the movement state to the initial state, and then, stops.

When the operator selects the second mode and when the operator applies the operational force to the trigger 14 while bringing the push lever 16 away from the workpiece 77, the trigger moves counterclockwise, and then, stops at the movement position. However, the power switch 45 remains turned OFF. The entire trigger arm 42 stops outside the movement range of the transmission member 75. Thus, even if the operator presses the push lever 16 against the workpiece 77 while applying the operational force to the trigger 14, the movement force of the transmission member 75 is not transmitted to the trigger arm 42. In other words, the trigger valve 51 remains in the standby state, and the striking unit 13 stops at the top dead center.

As described above, when the operator selects the second mode, regardless of whether the operator applies the operational force to the trigger 14 or releases the operational force to the trigger 14, the protrusion 108 is brought away from the holder 48, and the power switch 45 is turned OFF. Therefore, the slide member 81 always stops at the initial position.

When the driving tool 10 having the mechanism shown in FIG. 12(A) is switched from the state of the application of the operational force to the trigger 14 to the state of the release of the operational force from the trigger 14, the slide member 81 and the plunger 47 is moved against the force of the urging member 80 by the engagement of the protrusion 108 with the holder 48, and then, the slide member 81 and the plunger 47 stop at the movement position. Therefore, the operator can move the slide member 81 without applying the operational force to the slide member 81, and the operability of the driving tool 10 is improved.

(Another Example of Power Supply Unit)

FIGS. 15(A) and 15(B) show another example of the power supply unit 106. A holding hole 100 is provided in the end cover 22, and the power supply unit 106 is provided inside the handle 19, that is, the pressure accumulation chamber 20. The power supply unit 106 has an enclosure 101 and a battery cell 87. The enclosure 101 has a cylindrical shape, and the enclosure 101 is arranged in both the holding hole 100 and the pressure accumulation chamber 20. A cap 102 closes an opening of the enclosure g 101. A part of the cap 102 is arranged in the outside B1.

The battery cell 87 and the control unit 91 are arranged inside the enclosure 101. The battery cell 87 has a cylindrical shape, and a plurality of battery cells 87 are concentrically arranged. Inside the enclosure 101, a spring 103 is arranged between the cap 102 and one of the battery cells 87. The spring 103 electrically connects a terminal of the battery cell 87 and a terminal of the battery cell 87. The operator can detach the cap 102 from the enclosure 101, and insert/remove the battery cell 87 into/from the enclosure 101.

An example of a technical significance of the matters explained in the embodiments is as follows. The trigger 14 is an example of an operation member, and the push lever 16 is an example of a contact member. Each of the trigger arm 42 and the slide member 81 is an example of a transmission mechanism. Each of the solenoids 46, 60 and 104 is an example of an actuator, and the plunger 47 is an example of a movable member. The trigger valve 51 is an example of a driving unit and a valve. The plunger 52 is an example of a switching member. The keep solenoid 61 is an example of an actuator. The passage 110 is an example of a path. The state in which the slide member 81 is pressed against the plunger 52 is a transmission state. The state in which the slide member 81 is away from the plunger 52 or the state in which the plunger 52 enters the notch 82 is a disconnection state. The notch 82 is a non-contact portion. The piston upper chamber 36 is an example of a pressure chamber.

The driving tool is not limited to the above-described embodiments, and can be variously changed within the scope of the invention. For example, the power switch may be switched ON and OFF by an operation of a mode switching member. The power switch is turned ON when the first mode is selected and turned OFF when the second mode is selected. The power supply unit and the control unit may be provided in the magazine. The actuator provided in the operation member may be a pneumatic cylinder instead of the solenoid. The pneumatic cylinder is moved by the compressible gas of the pressure accumulation chamber.

EXPLANATION OF REFERENCE CHARACTERS

10 . . . driving tool, 13 . . . striking unit, 11 . . . housing, 14 . . . trigger, 16 . . . push lever, 18 . . . main body, 19 . . . handle, 20 . . . pressure accumulation chamber, 36 . . . piston upper chamber, 42 . . . trigger arm, 46, 60, 104 . . . solenoid, 47, 52 . . . plunger, 48 . . . holder, 48 . . . holder, 51 . . . trigger valve, 61 . . . keep solenoid, 81 . . . slide member, 86, 101 . . . enclosure, 91 . . . control unit, 106 . . . power supply unit, 110 . . . passage

The invention claimed is:

1. A driving tool comprising:

a striking unit configured to be movable to strike a fastener;

a housing configured to support the striking unit;

an operation member provided in the housing and configured to be moved by an operational force of an operator;

a contact member provided in the housing and configured to be movable in contact with a workpiece into which the fastener is driven; and a driving unit configured to have a standby state in which the striking unit is stopped and a movement state in which the striking unit is moved, and configured to be switched between the standby state and the movement state when a switching member moves, wherein the driving tool further includes:

a transmission mechanism provided to be movable in the operation member and configured to have a transmission state in which a movement force of the operation member and a movement force of the contact member can be transmitted to the switching member and a disconnection state in which the movement force of the operation member and the movement force of the contact member cannot be transmitted to the switching member; and an actuator provided in the operation member and configured to switch the transmission mechanism between the transmission state and the disconnection state, wherein in order to switch the driving unit from the standby state to the movement state, either movement of the contact member in a state of movement of the operation member or movement of the operation member in a state of movement of the contact member can be selected, wherein in a state of selection for the movement of the contact member in the state of the movement of the operation member to switch the driving unit from the standby state to the movement state, the actuator sets the transmission mechanism to be in the transmission state during a predetermined time from the movement of the operation member, and the actuator sets the transmission mechanism to be in the disconnection state after the predetermined time has elapsed from the movement of the operation member, wherein the actuator includes a movable member capable of moving and stopping, wherein, when power is supplied or stopped to the actuator, the movable member moves or stops, and wherein, when the movable member moves, the transmission mechanism moves so that the transmission state and the disconnection state are switched.

2. The driving tool according to claim 1, wherein the transmission mechanism includes:

a trigger arm provided to be movable with respect to the operation member; and a slide member provided in the trigger arm and configured to move together with the actuator, and the slide member is movable with respect to the trigger arm.

3. The driving tool according to claim 1, wherein the housing includes:

a main body configured to support the striking unit; and a handle configured to be connected to the main body and gripped by a hand when an operator operates the operation member, and a power supply unit is provided in the handle, and power can be supplied from the power supply unit to the actuator.

4. The driving tool according to claim 3, further comprising:

a control unit configured to supply or stop the power of the power supply unit to the actuator; and an enclosure capable of housing the power supply unit and the control unit, wherein the enclosure is attachable to and detachable from the handle.

5. The driving tool according to claim 1, further comprising:

a pressure accumulation chamber provided in the housing and configured to contain a compressible gas;

a pressure chamber configured to move the striking unit when the compressible gas is supplied from the pressure accumulation chamber; and a path configured to supply the compressible gas of the pressure accumulation chamber to the pressure chamber, wherein the standby state of the driving unit is to disconnect the path, and the movement state of the driving unit is to connect the path.

6. The driving tool according to claim 5, wherein the driving unit includes a valve configured to connect and disconnect the path, the valve includes the switching member configured to be moved by a movement force transmitted from the transmission mechanism, and the transmission mechanism has a contact portion capable of being in contact with the switching member and a non-contact portion not being in contact with the switching member.

7. The driving tool according to claim 1, wherein the actuator is a keep solenoid configured to move the movable member when the power is supplied, and stop the movable member when the supply of the power is stopped.

8. The driving tool according to claim 2, wherein a holder configured to support the transmission mechanism to be movable is provided in the housing, and, when the operator releases the operational force from the operation member, the slide member moves in contact with the holder.

9. A driving tool comprising:

a striking unit configured to be movable to strike a fastener;

a housing configured to support the striking unit;

an operation member provided in the housing and configured to be moved by an operational force of an operator;

a contact member provided in the housing and configured to be movable in contact with a workpiece into which the fastener is driven; and a driving unit configured to have a standby state in which the striking unit is stopped and a movement state in which the striking unit is moved, and configured to be switched between the standby state and the movement state when a switching member moves, wherein the driving tool further includes:

a transmission mechanism provided to be movable in the operation member and configured to have a transmission state in which a movement force of the operation member and a movement force of the contact member can be transmitted to the switching member and a disconnection state in which the movement force of the operation member and the movement force of the contact member cannot be transmitted to the switching member; and an actuator provided in the operation member and configured to switch the transmission mechanism between the transmission state and the disconnection state, wherein the transmission mechanism includes:

a trigger arm provided to be movable with respect to the operation member; and a slide member provided in the trigger arm and configured to move together with the actuator, wherein the slide member is movable with respect to the trigger arm, wherein the actuator includes a movable member capable of moving and stopping, wherein, when power is supplied or stopped to the actuator, the movable member moves or stops, and wherein, when the movable member moves, the transmission mechanism moves so that the transmission state and the disconnection state are switched.

10. A driving tool comprising:

a striking unit configured to be movable to strike a fastener;

a housing configured to support the striking unit;

an operation member provided in the housing and configured to be moved by an operational force of an operator;

a contact member provided in the housing and configured to be movable in contact with a workpiece into which the fastener is driven; and a driving unit configured to have a standby state in which the striking unit is stopped and a movement state in which the striking unit is moved, and configured to be switched between the standby state and the movement state when a switching member moves, wherein the driving tool further includes:

a transmission mechanism provided to be movable in the operation member and configured to have a transmission state in which a movement force of the operation member and a movement force of the contact member can be transmitted to the switching member and a disconnection state in which the movement force of the operation member and the movement force of the contact member cannot be transmitted to the switching member;

an actuator provided in the operation member and configured to switch the transmission mechanism between the transmission state and the disconnection state;

a pressure accumulation chamber provided in the housing and configured to contain a compressible gas;

a pressure chamber configured to move the striking unit when the compressible gas is supplied from the pressure accumulation chamber; and a path configured to supply the compressible gas of the pressure accumulation chamber to the pressure chamber, wherein the standby state of the driving unit is to disconnect the path, wherein the movement state of the driving unit is to connect the path, wherein the driving unit includes a valve configured to connect and disconnect the path, wherein the valve includes the switching member configured to be moved by a movement force transmitted from the transmission mechanism, wherein the transmission mechanism has a contact portion capable of being in contact with the switching member and a non-contact portion not being in contact with the switching member, wherein the actuator includes a movable member capable of moving and stopping, wherein, when power is supplied or stopped to the actuator, the movable member moves or stops, and wherein, when the movable member moves, the transmission mechanism moves so that the transmission state and the disconnection state are switched.

* * * * *